US009640864B2

(12) United States Patent
Wu et al.

(10) Patent No.: US 9,640,864 B2
(45) Date of Patent: May 2, 2017

(54) RADIO-FREQUENCY TRANSCEIVER DEVICE CAPABLE OF REDUCING SPECIFIC ABSORPTION RATE

(71) Applicant: Wistron NeWeb Corporation, Hsinchu (TW)

(72) Inventors: Yi-Feng Wu, Hsinchu (TW); Cheng-Wei Chang, Hsinchu (TW); Wei-Shan Chang, Hsinchu (TW); Chia-Tien Li, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 204 days.

(21) Appl. No.: 14/308,718

(22) Filed: Jun. 19, 2014

(65) Prior Publication Data

US 2014/0375520 A1 Dec. 25, 2014

Related U.S. Application Data

(60) Provisional application No. 61/837,181, filed on Jun. 20, 2013.

(51) Int. Cl.

| | |
|---|---|
| ***H01Q 1/52*** | (2006.01) |
| ***H01Q 17/00*** | (2006.01) |
| ***H01Q 1/24*** | (2006.01) |
| ***H01Q 5/371*** | (2015.01) |

(52) U.S. Cl.

CPC ..... *H01Q 1/52* (2013.01); *H01Q 1/245* (2013.01); *H01Q 5/371* (2015.01); *H01Q 17/001* (2013.01)

(58) Field of Classification Search

CPC ..... H01Q 1/245; H01Q 1/52

See application file for complete search history.

(56) References Cited

U.S. PATENT DOCUMENTS

| | | | | |
|---|---|---|---|---|
| 7,304,616 | B1 | 12/2007 | Chen | |
| 7,646,349 | B2 | 1/2010 | Wee | |
| 8,902,109 | B2 * | 12/2014 | Chiang | H01Q 1/243 343/702 |
| 2005/0024275 | A1 | 2/2005 | Jo | |
| 2011/0199272 | A1 | 8/2011 | He | |
| 2012/0038516 | A1 * | 2/2012 | Hsieh | H01Q 1/243 343/702 |

(Continued)

FOREIGN PATENT DOCUMENTS

| | | |
|---|---|---|
| CN | 101212500 A | 7/2008 |
| TW | I353689 | 12/2011 |

OTHER PUBLICATIONS

Antenna Theory: A Review, Balanis, Proc. IEEE vol. 80 No. 1 Jan. 1992.*

*Primary Examiner* — Robert Karacsony
*Assistant Examiner* — Amal Patel
(74) *Attorney, Agent, or Firm* — Winston Hsu; Scott Margo

(57) ABSTRACT

A radio-frequency transceiver device capable of reducing a specific absorption rate (SAR) includes an antenna including a radiating element and a grounding element, wherein the radiating element substantially extends along a first direction on a first plane; and a SAR suppression unit, substantially extending along the first direction and an edge of the radiating element of the antenna on the first plane and apart from the edge of the radiating element by a gap, for reducing the SAR of the antenna.

7 Claims, 38 Drawing Sheets

(56) References Cited

U.S. PATENT DOCUMENTS

| | | | | |
|---|---|---|---|---|
| 2013/0069846 | A1* | 3/2013 | Chang | H01Q 1/243 343/872 |
| 2014/0253411 | A1* | 9/2014 | Zhang | H01Q 1/243 343/904 |

* cited by examiner

RADIO-FREQUENCY TRANSCEIVER DEVICE CAPABLE OF REDUCING SPECIFIC ABSORPTION RATE

CROSS REFERENCE TO RELATED APPLICATIONS

This application claims the benefit of U.S. Provisional Application No. 61/837,181, filed on Jun. 20, 2013 and entitled "Wireless Communication Device with SAR Suppression Unit", the contents of which are incorporated herein by reference.

BACKGROUND OF THE INVENTION

1. Field of the Invention

The present invention relates to a Radio-Frequency transceiver device, and more particularly to a RF transceiver device capable of reducing Specific Absorption Rate and keeping the antenna efficiency or structure.

2. Description of the Prior Art

A wireless communication device is equipped with an antenna to emit or receive radio waves, so as to exchange radio-frequency (RF) signals and access a wireless communication system. Radio waves are high-frequency sinusoidal signals, such that every country in the world standardizes the power of radio waves, mainly for preventing from affecting users and/or interfering operations of other wireless communication devices. For example, the International Commission on Non-Ionizing Radiation Protection (ICNIRP) suggests the value of Specific Absorption Rate (SAR) shall not exceed 2.0 W/Kg, while the Federal Communications Commission (FCC) suggests the value of SAR shall not exceed 1.6 W/Kg. SAR represents the absorption rate of a living body unit per the power of electromagnetic waves in a normal electromagnetic radiation environment, taking W/Kg as a unit. Additionally, various communication products are applied to various environments, so that distance factor is further taken into consideration. For example, SAR of handset wireless communication device such as mobile device or smart phones needs to be verified when the distance between the handset wireless communication device and a human body is 20 cm.

As well known in the art, enhancing antenna efficiency and reducing SAR value are often contradictory, because enhancing antenna efficiency may increase radiating power which increases SAR value. In such a situation, how to keep the antenna efficiency and meanwhile reduce SAR value has become a target of the industry.

SUMMARY OF THE INVENTION

It is therefore a primary objective of the present invention to provide a radio-frequency transceiver device, capable of reducing a specific absorption rate (SAR).

An embodiment of the present invention discloses a radio-frequency (RF) transceiver device, capable of reducing a specific absorption rate (SAR), which comprises an antenna, comprising a radiating element and a grounding element, wherein the radiating element substantially extends along a first direction on a first plane; and a SAR suppression unit, substantially extending along the first direction and an edge of the radiating element of the antenna on the first plane and apart from the edge of the radiating element by a gap, for reducing the SAR of the antenna.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
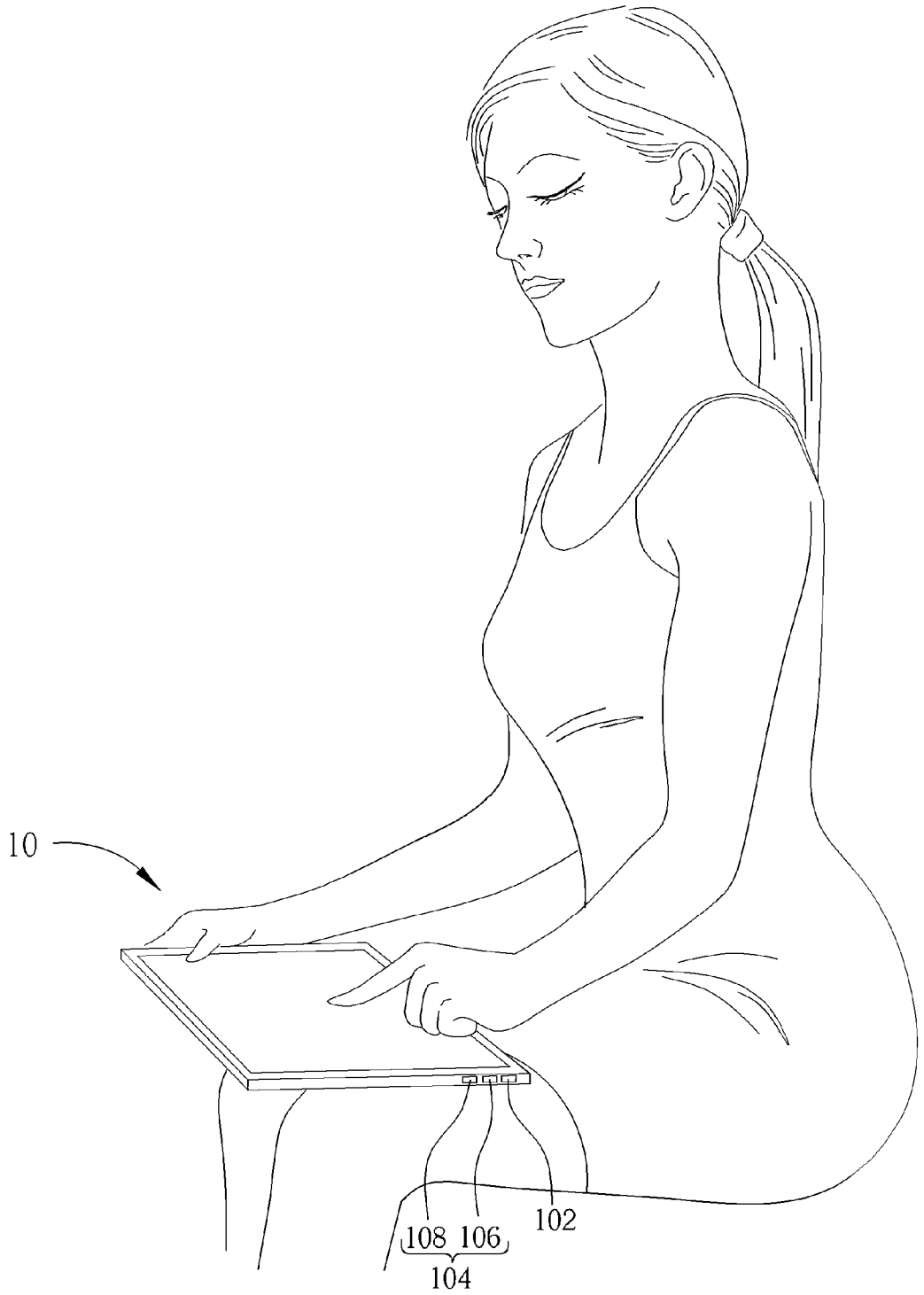
FIG. 1A is a schematic diagram of a wireless communication device according to an embodiment of the present invention.
Figure 1B:
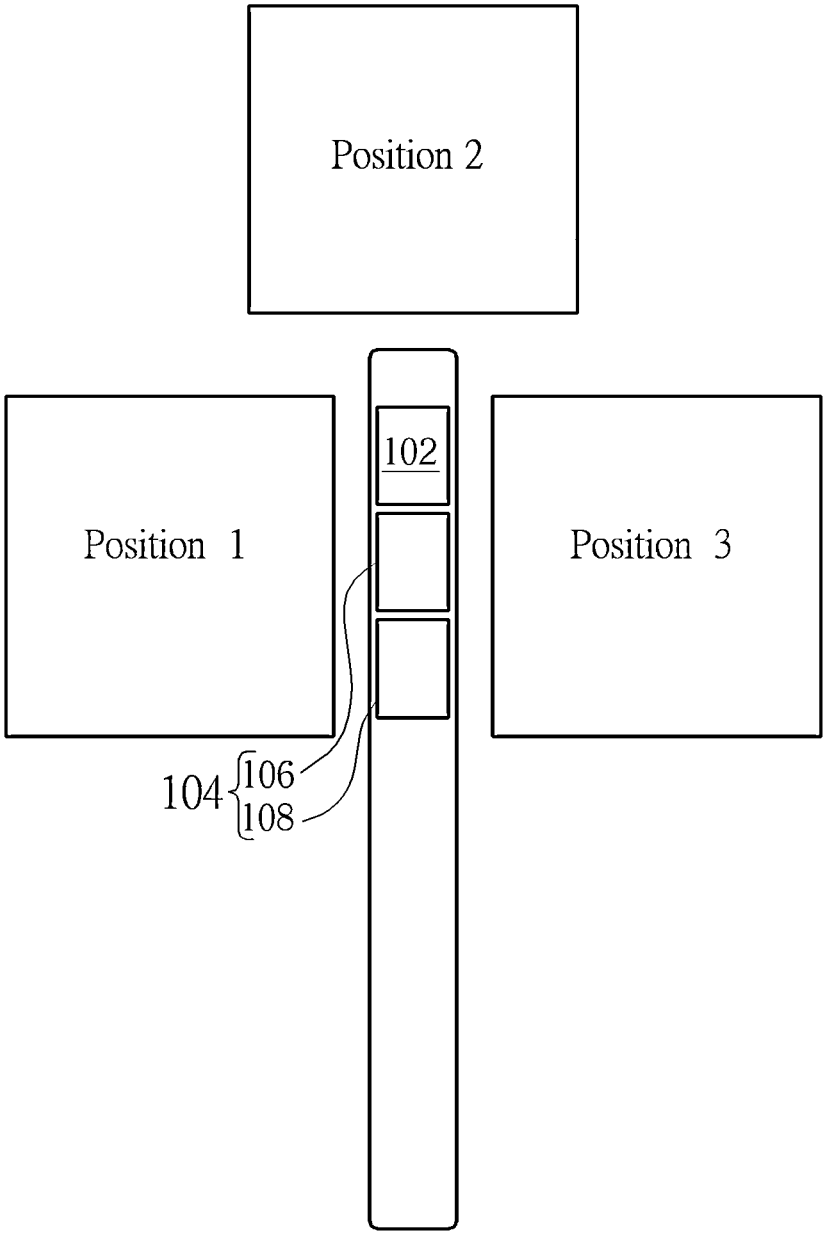
FIG. 1B is a schematic diagram depicting three main body scenarios when a user is operating the wireless communication device shown in FIG. 1A.
Figure 1C:
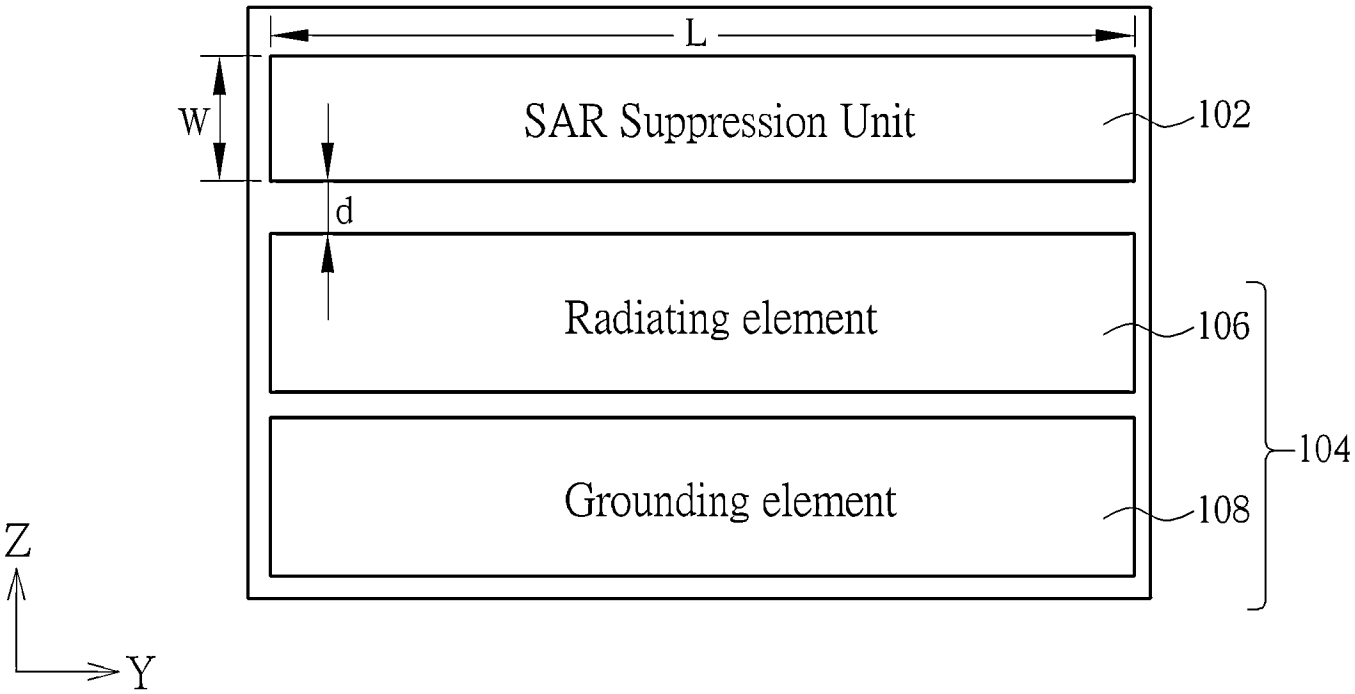
FIG. 1C illustrates a schematic diagram of structures of a SAR suppression unit and an antenna shown in FIG. 1A.

Please refer to FIG. 1A and FIG. 1B. FIG. 1A is a schematic diagram of a wireless communication device 10 according to an embodiment of the present invention, and FIG. 1B is a schematic diagram depicting three main body scenarios when a user is operating the wireless communication device 10. The wireless communication device 10 may be a laptop, tablet PC, smart phone, etc., and comprises a SAR suppression unit 102 and an antenna 104. The antenna 104 comprises a radiating element 106 and a grounding element 108 (and a feeding unit not shown in FIG. 1A), and is utilized for transmitting and receiving radio-frequency (RF) signals. The SAR suppression unit 102 may be a conductive unit, a magnetic unit (e.g. ferrite), and is utilized for reducing SAR value of the wireless communication device 10. Please further refer to FIG. 1C, which illustrates a schematic diagram of structures of the SAR suppression unit and the antenna 104. As can be seen from FIG. 1C, the SAR suppression unit 102 is disposed around or near the radiating element 106 of the antenna 104, and extends along an edge of the radiating element 106. In addition, FIG. 1C illustrates a plane coordinate system Y-Z. As can be seen, the radiating element 106 is disposed on the Y-Z plane and extends along the horizontal direction (or first direction) Y of FIG. 1C, while the SAR suppression unit 102 is also disposed on the Y-Z plane, and extends along the horizontal direction Y and the edge of the radiating element 106.

In FIG. 1C, "d" represents a gap between the SAR suppression unit 102 and the antenna 104, and is substantially between 0.1 mm. and 10 mm; "W" represents a width of the SAR suppression unit 102, and is substantially greater than 0.1 mm; and "L" represents a length of the SAR suppression unit 102, and is substantially equal to ¼ wavelength corresponding to a lowest operating frequency of the antenna 104. With such a structure, the SAR suppression unit 102 can reduce SAR value for each operating band of the antenna 104 while keeping the antenna efficiency or structure of the antenna 104.

Figure 2:
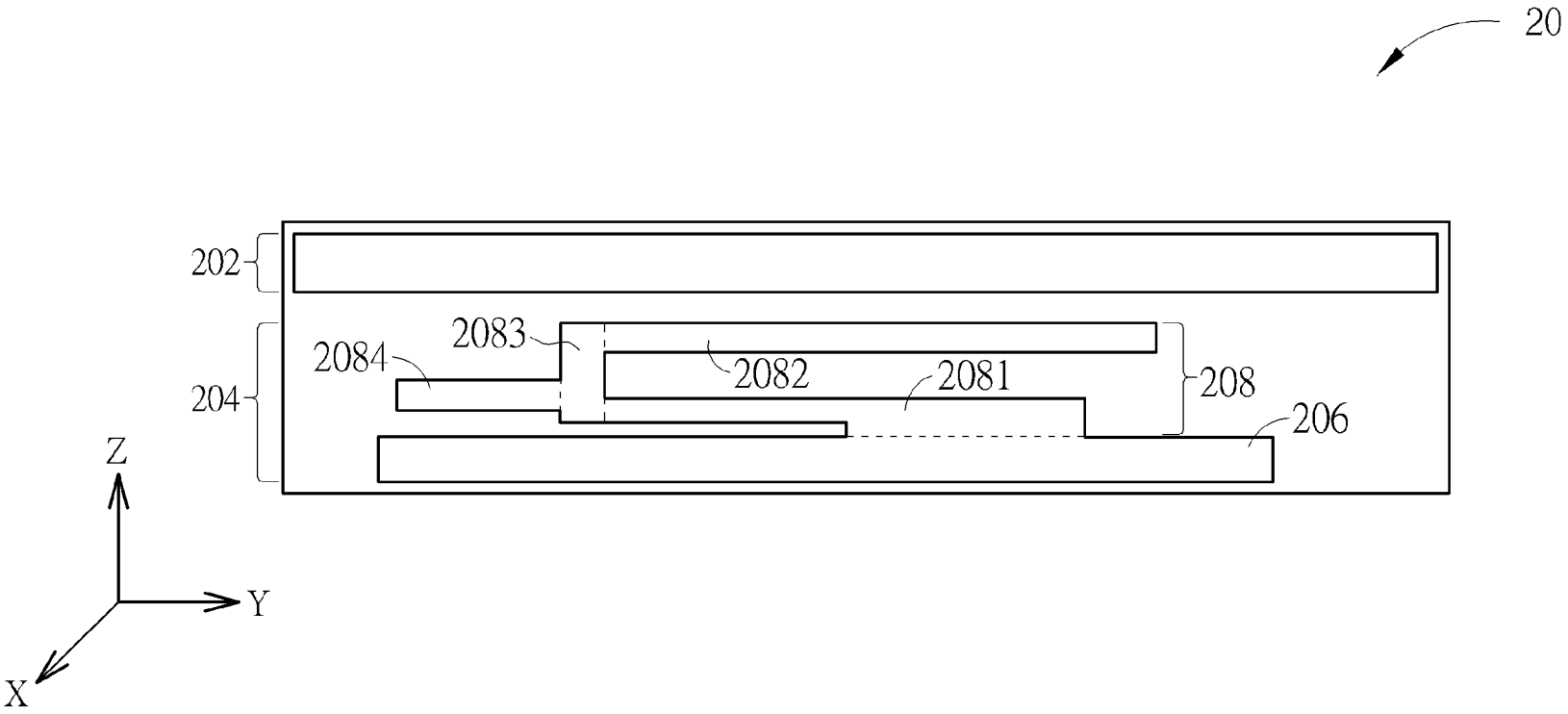
FIG. 2 is a schematic diagram of an RF transceiver device according to an embodiment of the present invention.

For example, please refer to FIG. 2, which is a schematic diagram of an RF transceiver device 20 according to an embodiment of the present invention, where an X-Y-Z coordinate system is marked. The RF transceiver device 20 comprises a SAR suppression unit 202 and an antenna 204, which may implement the SAR suppression unit 102 and the antenna 104 shown in FIGS. 1A-1C, to apply to the wireless communication device 10. The antenna 204 includes a grounding element 206 and a radiating element 208. The grounding element 206 extends along a first direction (Y axis) on a first plane (Y-Z plane). The radiating element 208 includes a first branch 2081, a second branch 2082, a third branch 2083 and a fourth branch 2084. The first branch 2081 extends along the first direction and is electrically connected to the grounding element 206. The second branch 2082 extends along the first direction. The third branch 2083 is electrically connected to and perpendicular to the first branch 2081 and the second branch 2082. The fourth branch 2084 extends along the first direction, and is electrically connected to the third branch 2083. The SAR suppression unit 202 is designed and configured according to the above rule (i.e. disposing position, length, width, gap to the antenna 204, etc.), and therefore, can reduce SAR values for each operating band of the antenna 204 while keeping the antenna efficiency or structure of the antenna 204. Measurement results are shown in Tables I-V:

TABLE I

| Without SAR suppression unit 202 at 2462 MHz | | |
|---|---|---|
| Test Position | Measured SAR 1 g (W/kg) | Scaled SAR 1 g (W/kg) |
| Position 1 | 1.22 | 1.547 |
| Position 2 | 0.353 | 0.447 |
| Position 3 | 0.733 | 0.929 |

TABLE II

| With SAR suppression unit 202 at 2462 MHz | | |
|---|---|---|
| Test Position | Measured SAR 1 g (W/kg) | Scaled SAR 1 g (W/kg) |
| Position 1 | 0.857 | 1.086 |
| Position 2 | 0.252 | 0.319 |
| Position 3 | 0.575 | 0.729 |

TABLE III

| Without SAR suppression unit 202 at 5785 MHz | | |
|---|---|---|
| Test Position | Measured SAR 1 g (W/kg) | Scaled SAR 1 g (W/kg) |
| Position 1 | 2.55 | 3.323 |
| Position 2 | 1.3 | 1.694 |
| Position 3 | 0.787 | 1.026 |

TABLE IV

| With SAR suppression unit 202 at 5785 MHz | | |
|---|---|---|
| Test Position | Measured SAR 1 g (W/kg) | Scaled SAR 1 g (W/kg) |
| Position 1 | 0.404 | 0.526 |
| Position 2 | 0.276 | 0.36 |
| Position 3 | 0.252 | 0.328 |

TABLE V

| Band | Frequency (MHz) | Gain Spec | Antenna gain without SAR suppression unit 202 | Antenna gain with SAR suppression unit 202 |
|---|---|---|---|---|
| 802.11g | 2400 | −4.3 | −3.50 | −3.65 |
| | 2450 | −4.3 | −3.68 | −3.70 |
| | 2500 | −4.3 | −3.25 | −3.25 |
| 802.11a | 5150 | −5.3 | −2.57 | −2.88 |
| | 5250 | −5.3 | −2.67 | −2.91 |
| | 5350 | −5.3 | −2.53 | −3.11 |
| | 5470 | −5.3 | −2.88 | −3.44 |
| | 5600 | −5.3 | −2.78 | −3.06 |
| | 5725 | −5.3 | −3.06 | −3.34 |
| | 5785 | −5.3 | −3.33 | −3.85 |
| | 5850 | −5.3 | −3.40 | −4.08 |

Tables I-IV show SAR values measured at three test positions (e.g. front surface, edge, bottom as shown in FIG. 1B), at 2462 MHz and 5785 MHz, for scenarios of the RF transceiver device 20 equipped with or without SAR suppression unit 202. Table V represent measurement results of passive gains of the antenna 204 in the band 802.11a and 802.11g with and without the SAR suppression unit 202. As can be seen from Tables I-IV, the SAR suppression unit 202 obviously reduces SAR values, for example, reduces SAR of the test position 1 by 0.46 (W/kg) at 2462 MHz and by 2.8 (W/kg) at 5785 MHz. Therefore, the SAR suppression unit 202 can efficiently reduce the SAR values of the antenna 204 at different operating frequencies. Moreover, as can be seen from Table V, the passive gains of the antenna 204 substantially keep at the same levels no matter whether the SAR suppression unit 202 is added or not. That is, as the SAR suppression unit 202 reduces the SAR values, the antenna efficiency is kept.

Figure 3A:
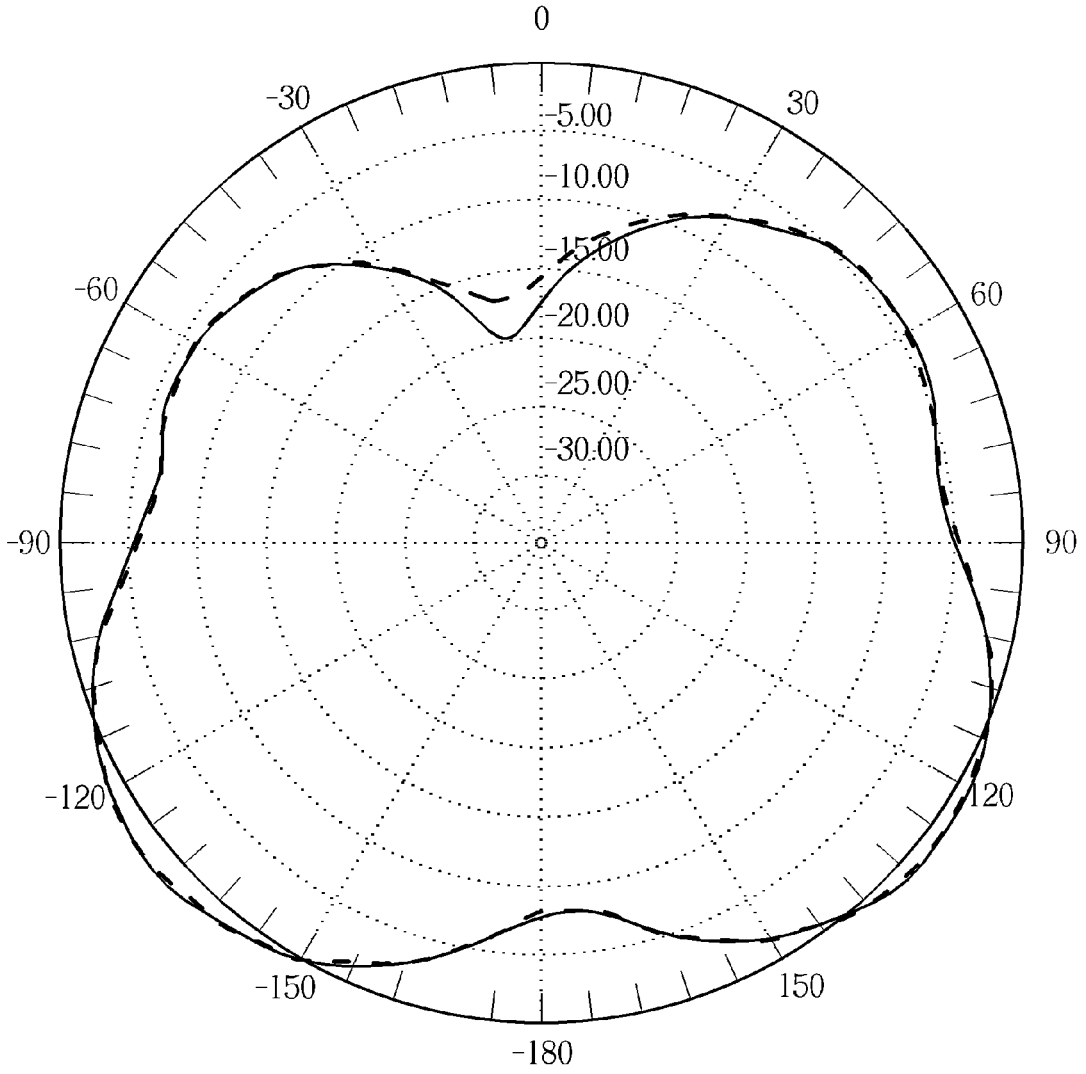
FIGS. 3A, 3B, 4A and 4B illustrate schematic diagrams of simulated radiation patterns before and after the RF transceiver device shown in FIG. 2 is equipped with a SAR suppression unit.
Figure 3B:
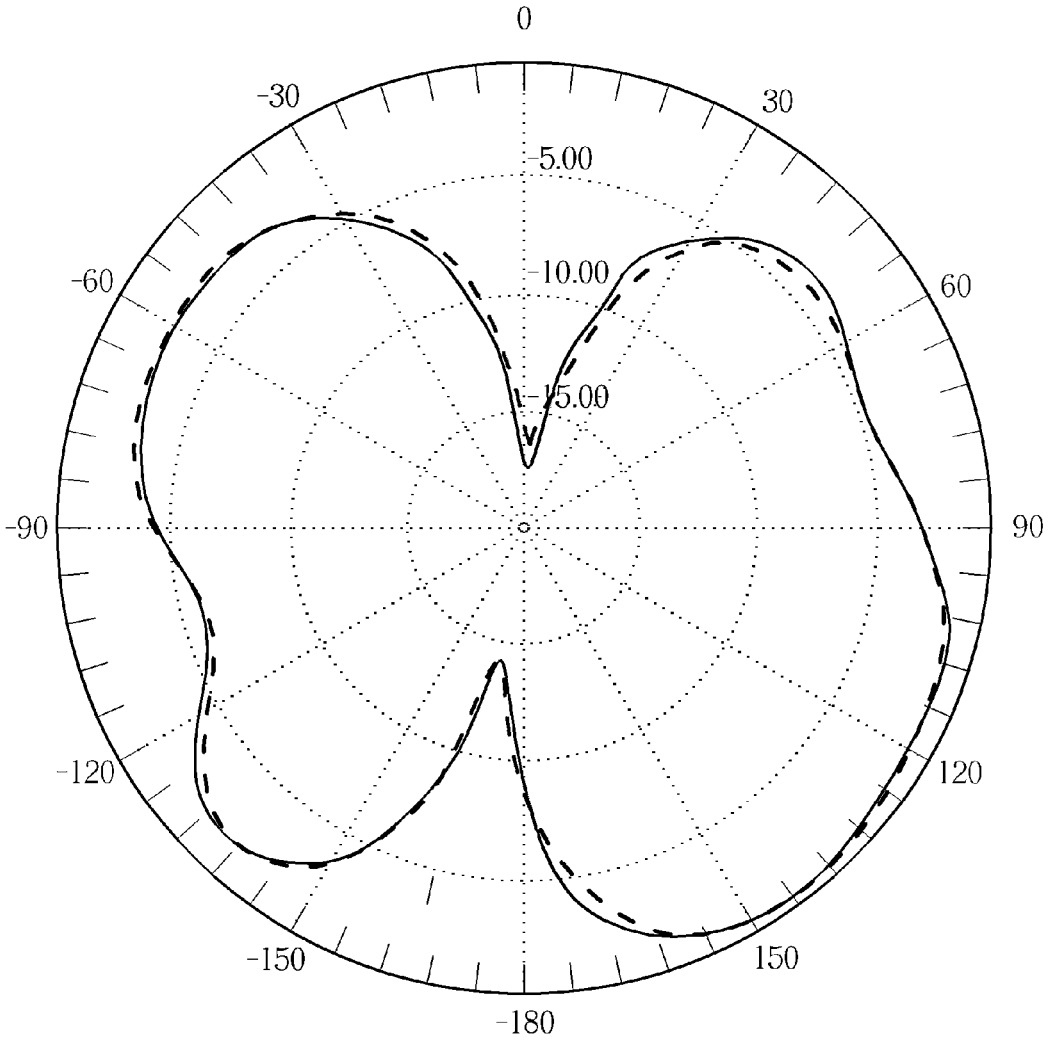
Figure 4A:
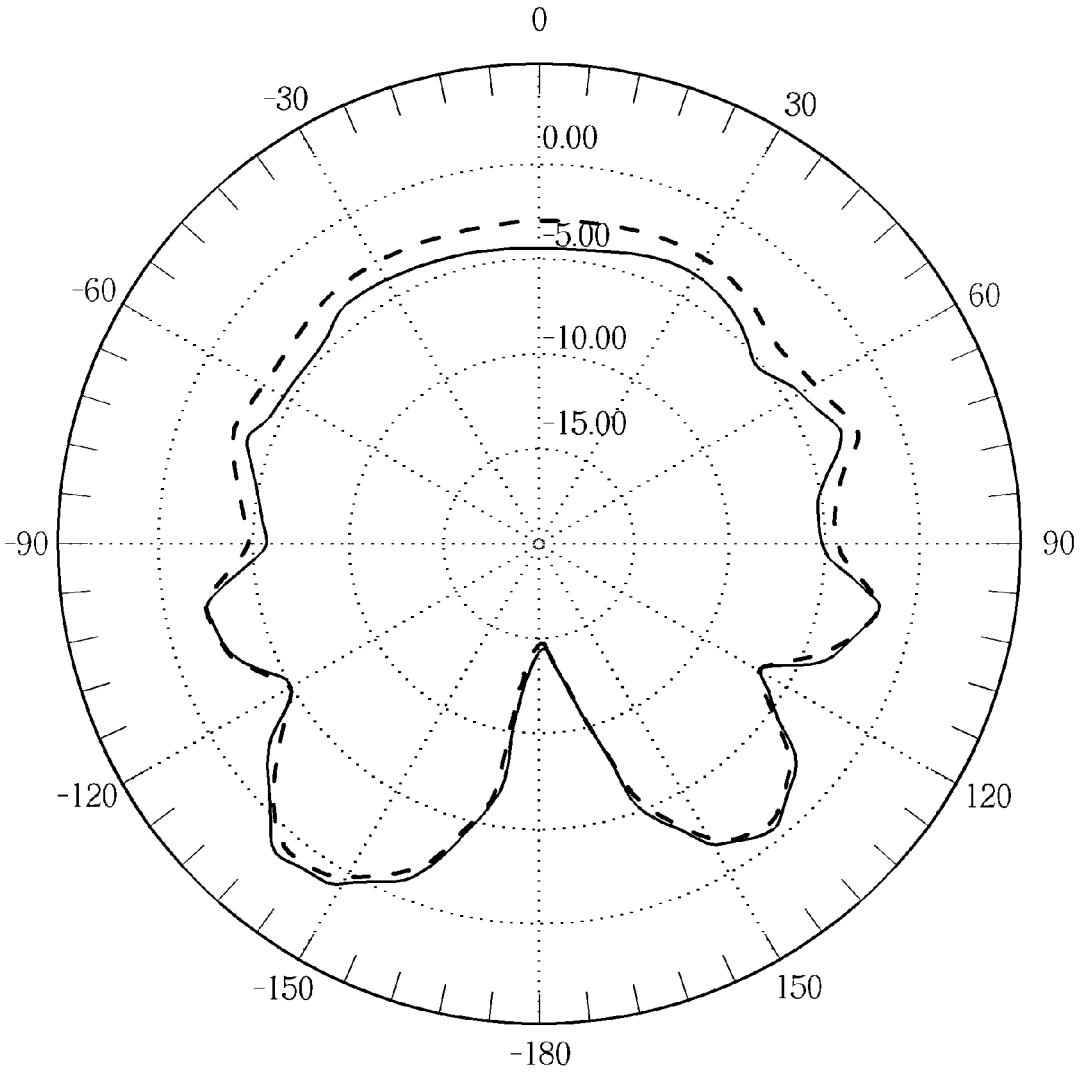
Figure 4B:
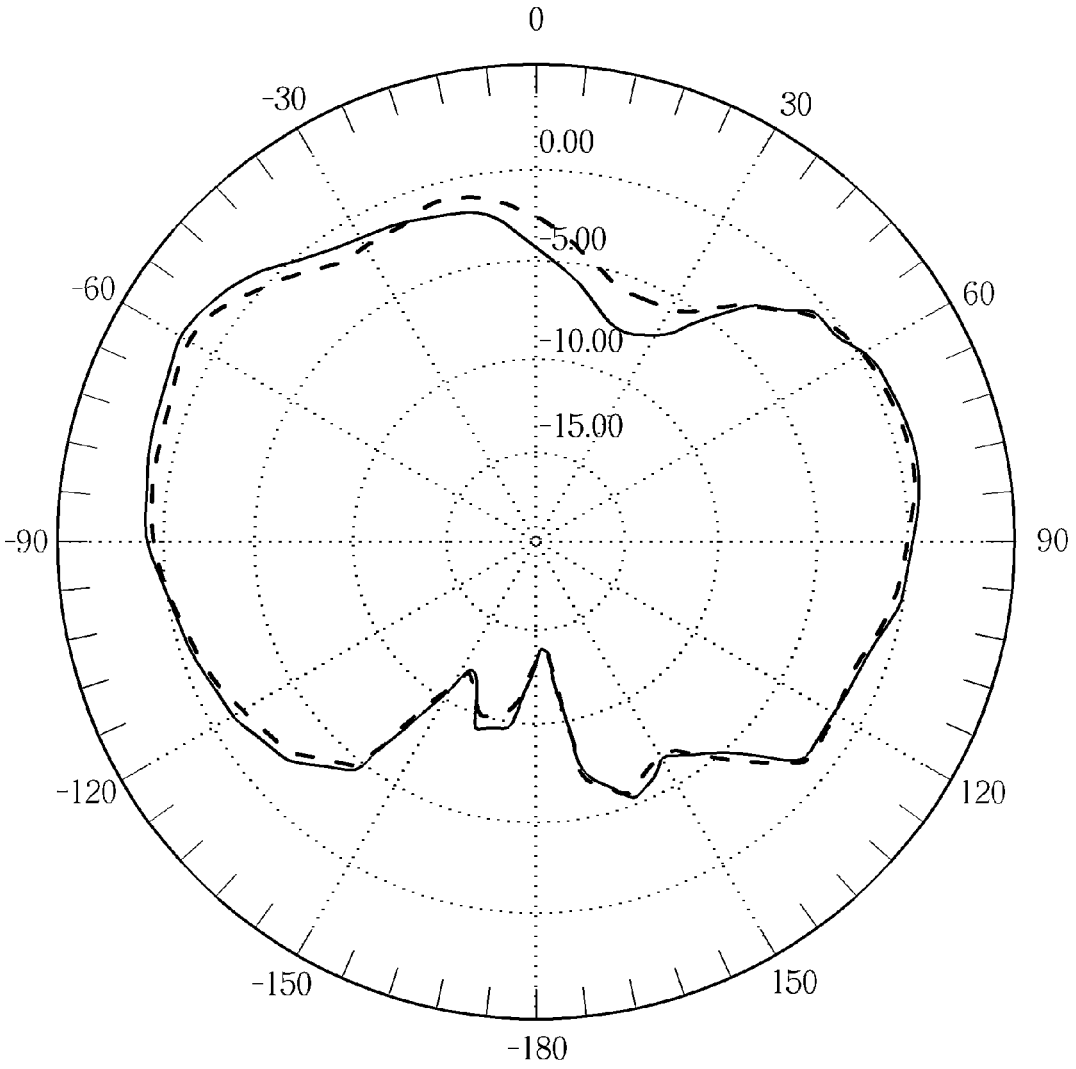

Furthermore, please refer to FIGS. 3A, 3B, 4A and 4B, which illustrate schematic diagrams of simulated radiation patterns before and after the RF transceiver device 20 is equipped with the SAR suppression unit. FIGS. 3A and 3B are schematic diagrams of X-Z and Y-Z (relationships between X-Z or Y-Z plane and the antenna 204 can refer to FIG. 2) radiation patterns of the antenna 204 simulated by HFSS at 2 GHz without and with the SAR suppression unit 202, and FIGS. 4A and 4B are schematic diagrams of X-Z and Y-Z radiation patterns of the antenna 204 simulated by HFSS at 5 GHz without and with the SAR suppression unit 202. As can be seen, after the SAR suppression unit 202 is added, the gains of the antenna 204 are reduced by 2-3 dB around 0° at both 2 GHz and 5 GHz and in both X-Z plane and Y-Z plane. Therefore, the patterns are changed to reduce SAR value.

Figure 5A:
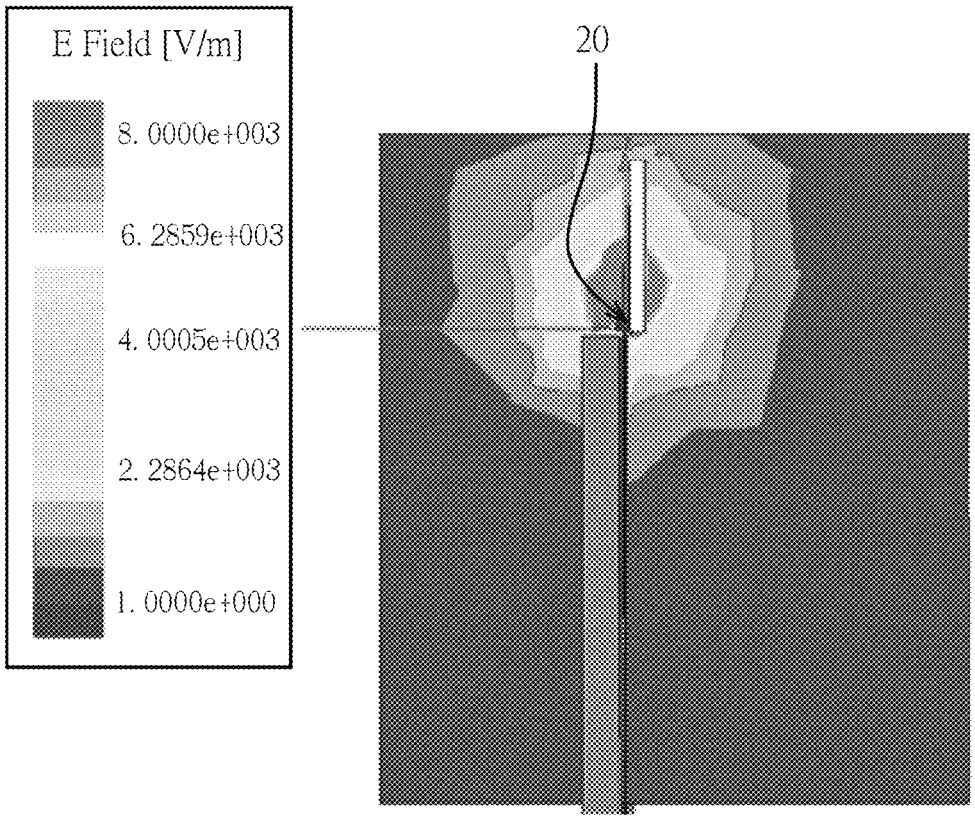
FIGS. 5A, 5B, 6A and 6B are schematic diagrams of electric field of an antenna of the RF transceiver device shown in FIG. 2 without and with a SAR suppression unit.
Figure 5B:
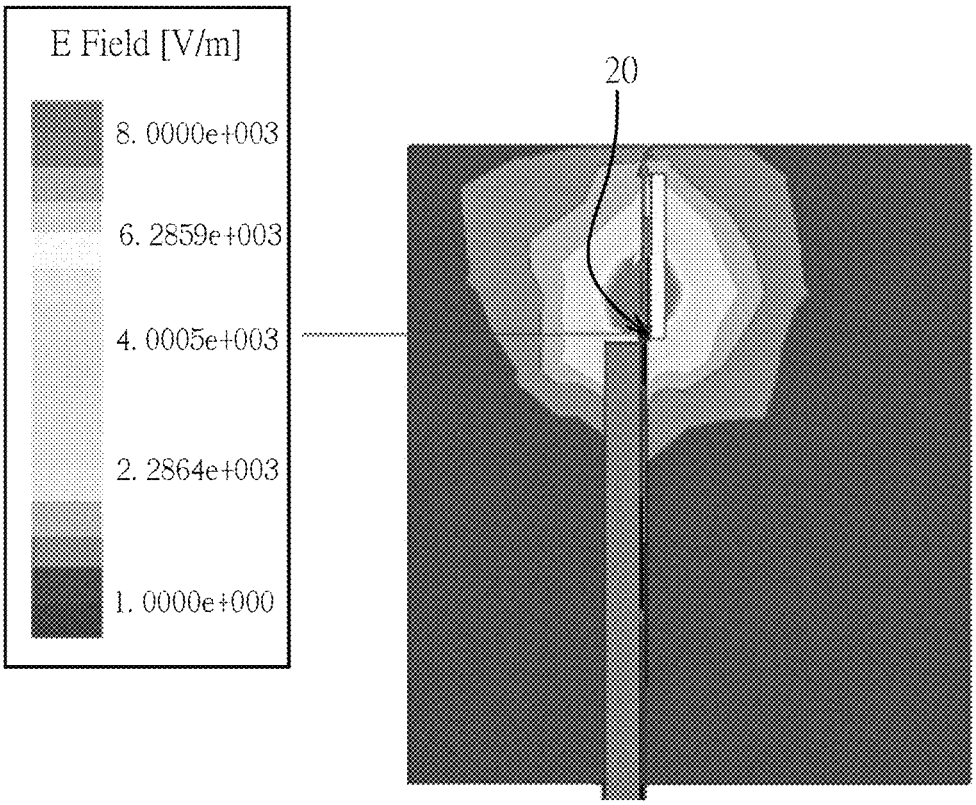
Figure 6A:
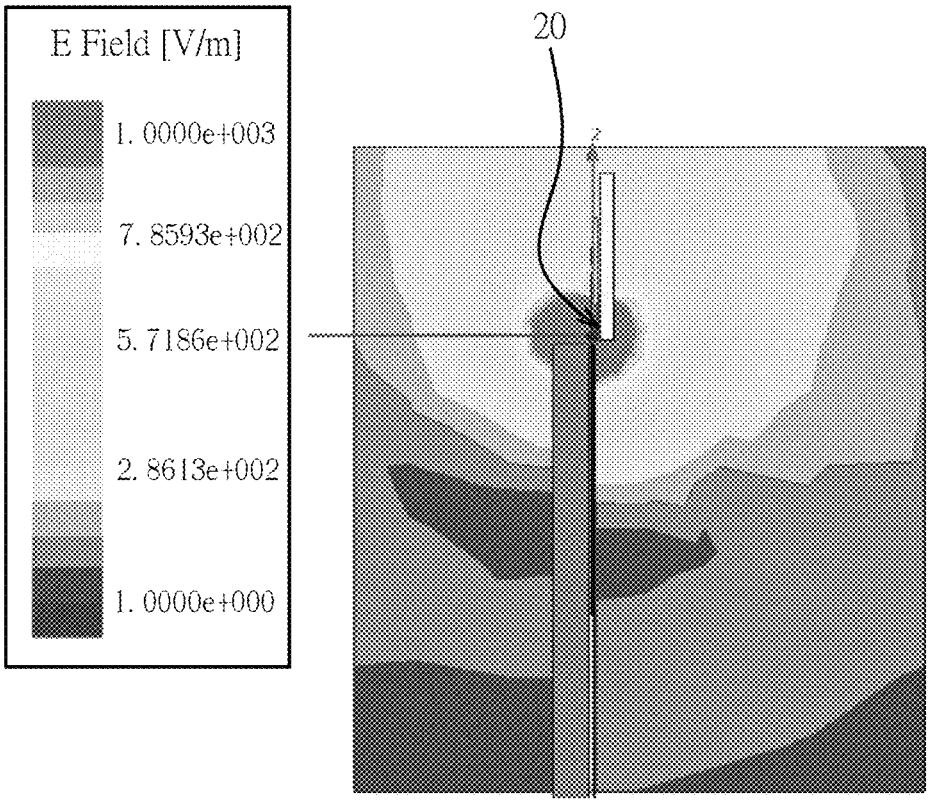
Figure 6B:
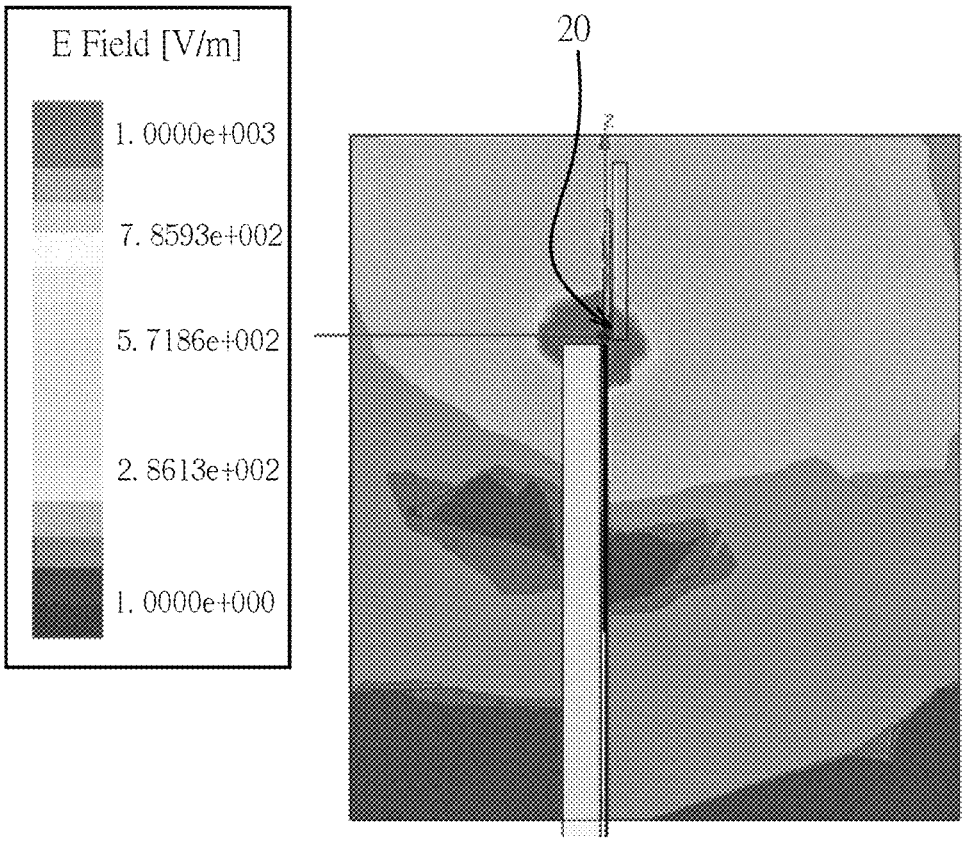

FIGS. 5A and 5B are schematic diagrams of electric field (E-field) of the antenna 204 at 2 GHz without and with the SAR suppression unit 202, and FIGS. 6A and 6B are schematic diagrams of electric field of the antenna 204 at 5 GHz without and with the SAR suppression unit 202. As can be seen from FIGS. 5A, 5B, 6A, 6B, after the SAR suppression unit 202 is added, the electric field of the antenna 204 is obviously reduced along the Z+ direction, so as to reduce SAR values.

Figure 7:
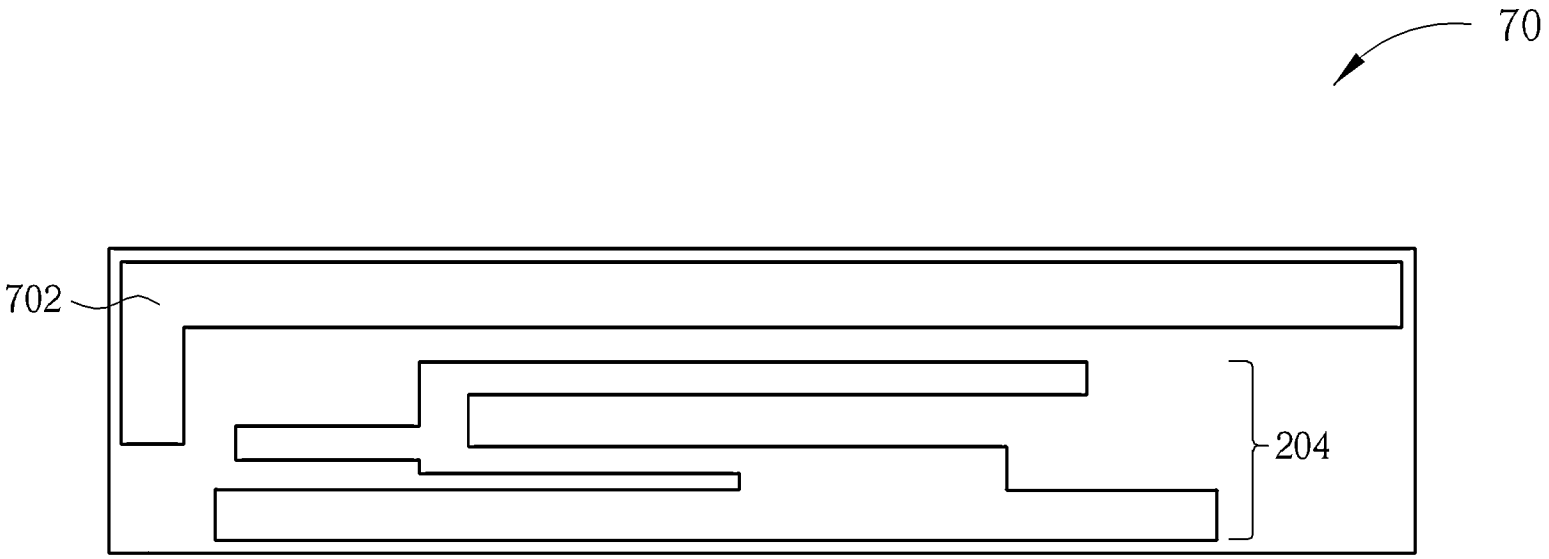
FIGS. 7, 8 and 9 are schematic diagrams of RF transceiver devices according to embodiments of the present invention.
Figure 8:
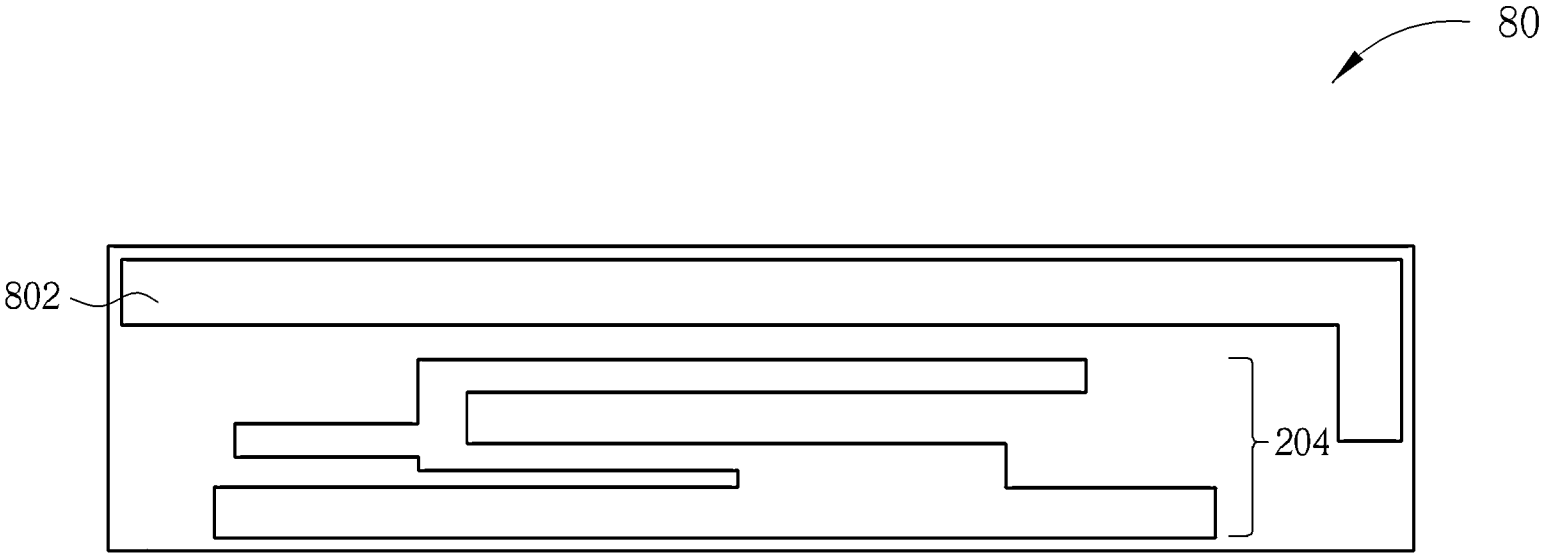
Figure 9:
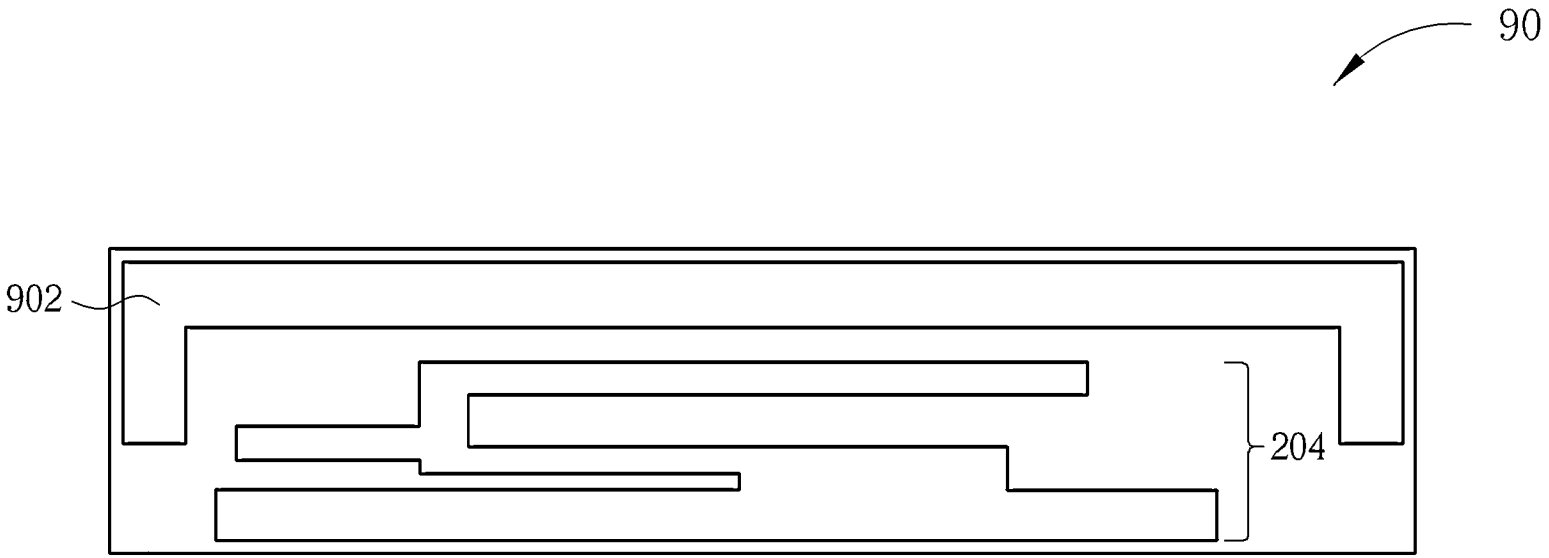

Note that, the RF transceiver device 20 is an embodiment of the present invention, and those skilled in the art should readily make modifications according to different requirements. For example, the pattern of the antenna 204 or characteristics of the SAR suppression unit 202, such as shape, size, material, distance to the antenna 204, etc., can be altered according to different requirements. Please refer to FIGS. 7 to 9, which are schematic diagrams of RF transceiver devices 70, 80 and 90 according to embodiments of the present invention. The RF transceiver devices 70, 80 and 90 are derived from the RF transceiver device 20 by replacing the SAR suppression unit 202 with SAR suppression units 702, 802 and 902 respectively. Thus, the SAR suppression units 702, 802 and 902 can also reduce SAR values for each operating band of the antenna 204 while keeping the antenna efficiency or structure of the antenna 204. The major difference between the SAR suppression units 702/802 and the SAR suppression unit 202 is the SAR suppression units 702/802 respectively include a bend at one side. And, the major difference between the SAR suppression unit 902 and the SAR suppression unit 202 is the SAR suppression unit 902 includes bends at two sides.

Figure 10:
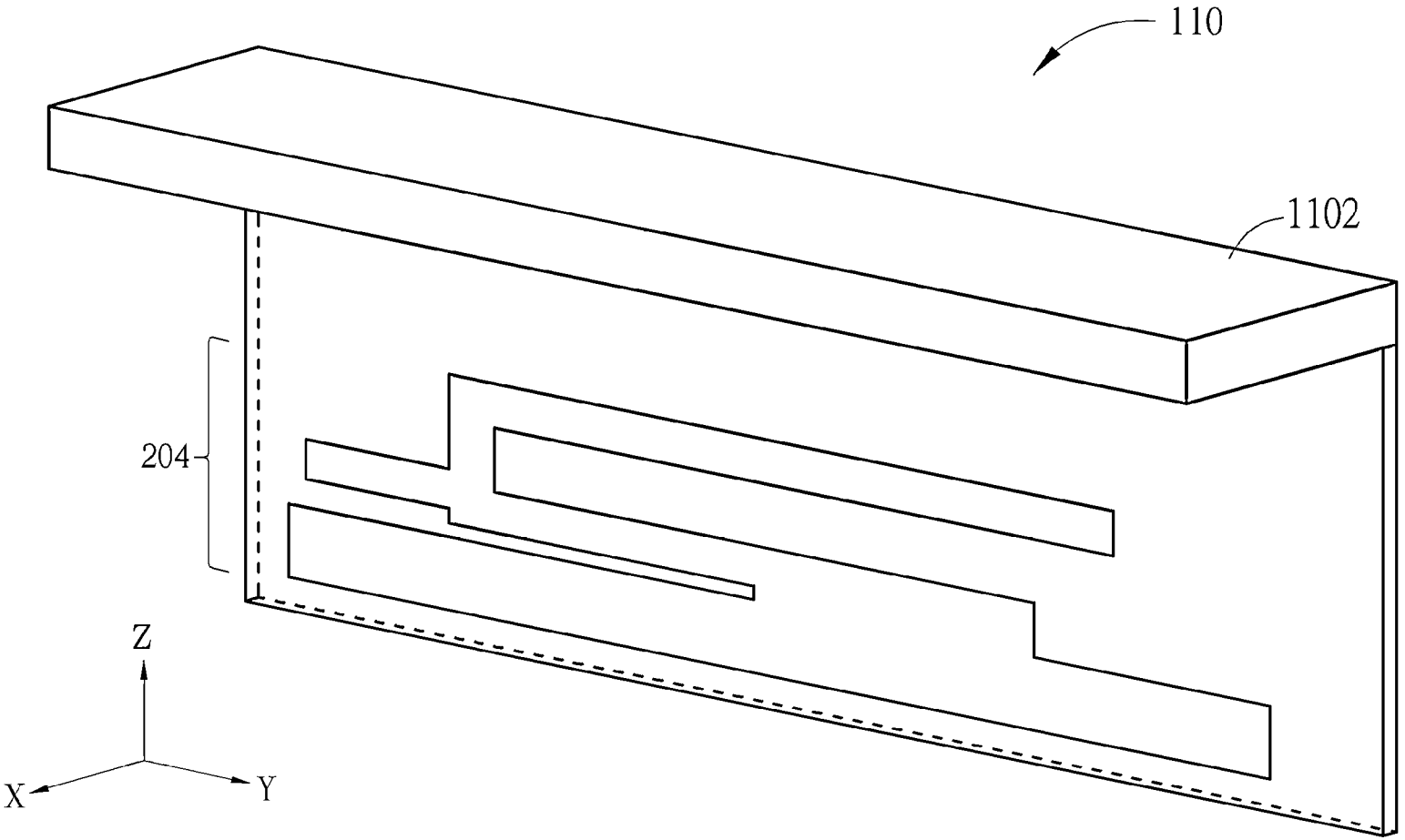
FIG. 10 illustrates a 3D schematic diagram of an RF transceiver device according to an embodiment of the present invention.

In the above examples, the SAR suppression unit 202 and the antenna 204 extends on the same plane; however, the present invention is not limited thereto. For example, please refer to FIG. 10, which illustrates a 3D schematic diagram of an RF transceiver device 110 according to an embodiment of the present invention. The structure of the RF transceiver device 110 is similar to that of the RF transceiver device 20, and the difference is that a SAR suppression unit 1102 of the RF transceiver device 110 extends on the X-Y plane, and the antenna 204 extends on Y-Z plane. In other words, the SAR suppression unit 1102 and the antenna 204 extend on different planes, which still conforms to the scope of the present invention. Therefore, the SAR suppression unit 1102 can reduce SAR values for each operating band of the antenna 204 while keeping the antenna efficiency or structure of the antenna 204.

Figure 11:
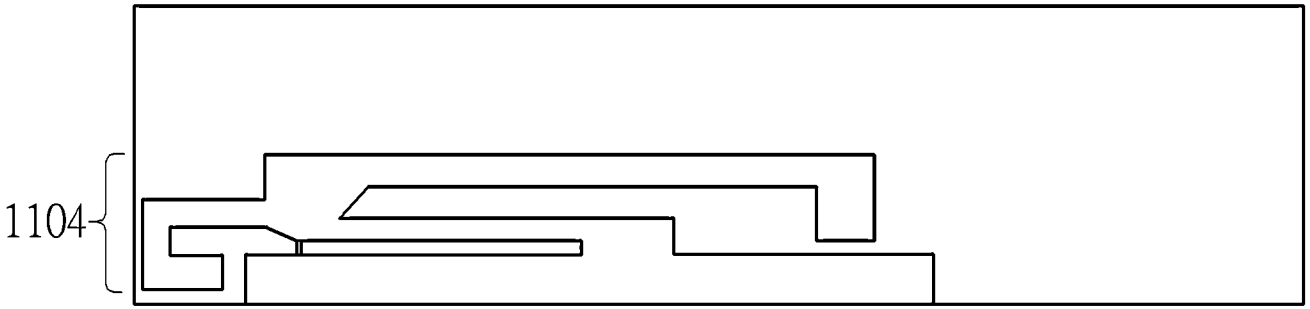
FIG. 11 is a schematic diagram of an antenna according to an embodiment of the present invention.
Figure 12:
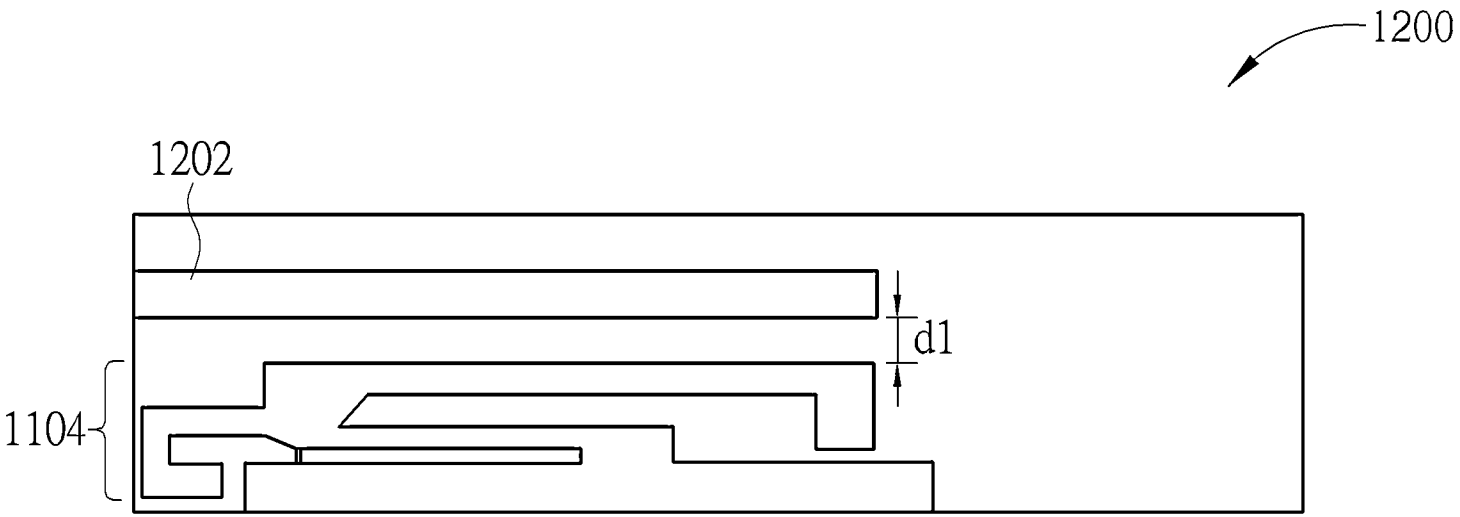
FIGS. 12 and 13 are schematic diagrams of RF transceiver devices according to embodiments of the present invention.
Figure 13:
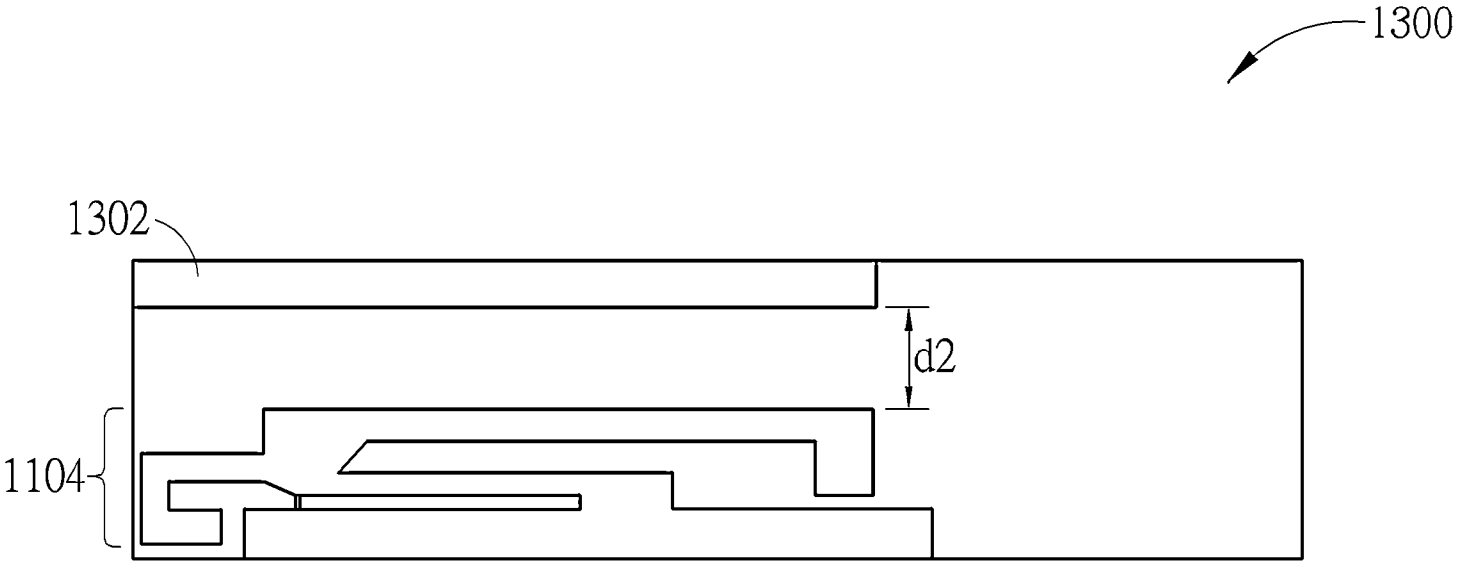

In addition, the antenna 204 is an example for illustration. In fact, the SAR suppression unit 202 or its derivatives (e.g. the SAR suppression units 702, 802 and 902 shown in FIGS. 7-9) are suitable for different kinds of antennas, and can be appropriately adjusted according to different requirements. For example, FIG. 11 is a schematic diagram of an antenna 1104 according to an embodiment of the present invention. The antenna 1104 is similar to the antenna 204, and can operate in dual band (2 GHz, 5 GHz), such that the SAR suppression unit 202 or its derivatives can apply to the antenna 1104, to reduce SAR values for each operating band of the antenna 1104 while keeping the antenna efficiency or structure of the antenna 1104. For example, FIGS. 12 and 13 are schematic diagrams of RF transceiver devices 1200 and 1300 according to embodiments of the present invention. The RF transceiver devices 1200 and 1300 add SAR suppression units 1202 and 1302 around the radiating element of the antenna 1104 respectively, and the difference between the RF transceiver devices 1200 and 1300 is d1/d2, which are distances between the SAR suppression units 1202/1302 and the antenna 1104. In such a situation, the RF transceiver devices 1200, 1300 can reach different SAR suppression effects.

Figure 14:
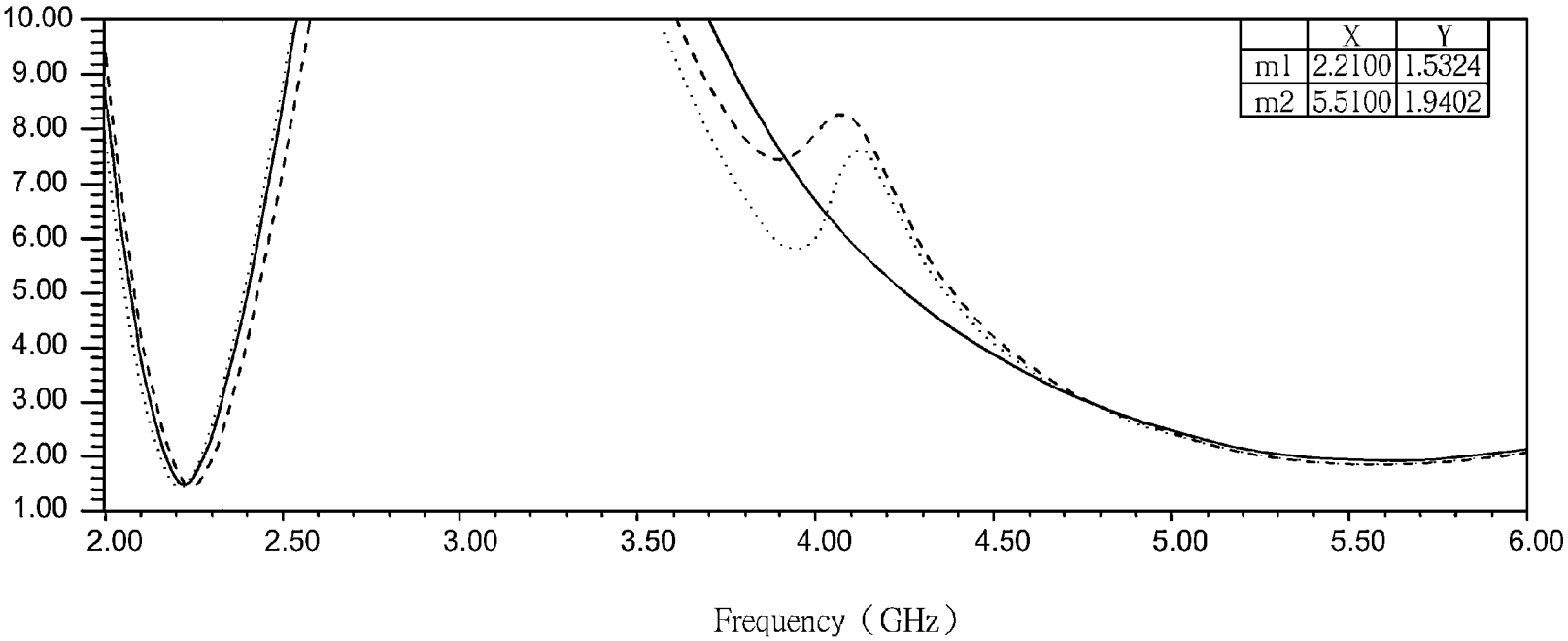
FIG. 14 is a schematic diagram of Voltage Standing Wave Ratio of the antenna shown in FIG. 11, the RF transceiver device shown in FIG. 12 and the RF transceiver device shown in FIG. 13.
Figure 15A:
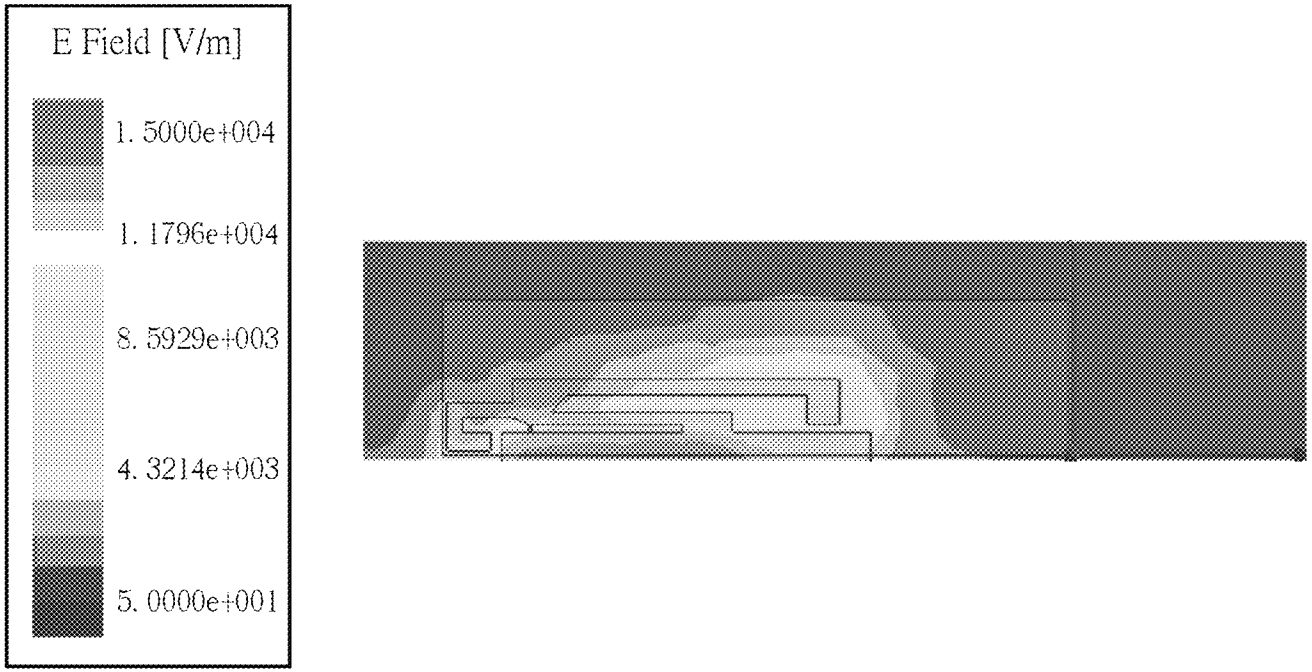
FIGS. 15A-15C are schematic diagrams of electric fields of the antenna shown in FIG. 11, the RF transceiver device shown in FIG. 12 and the RF transceiver device shown in FIG. 13 at 2.21 GHz.
Figure 15B:
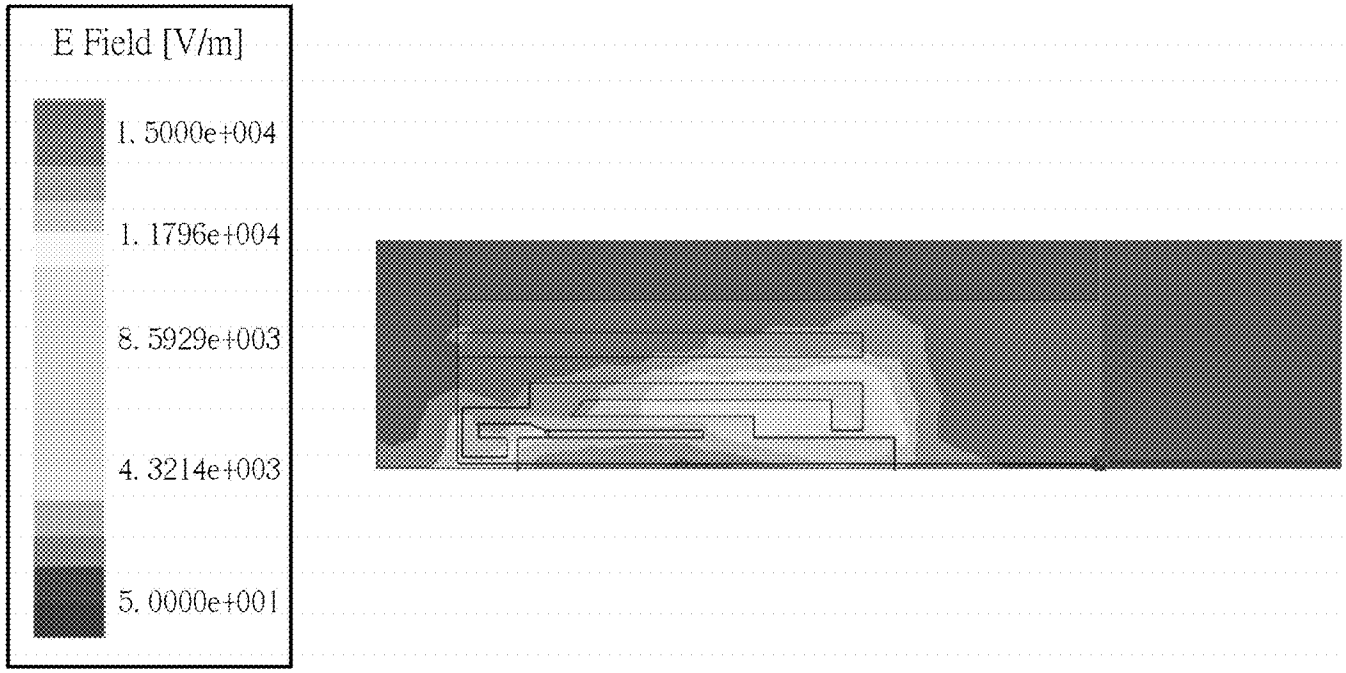
Figure 15C:
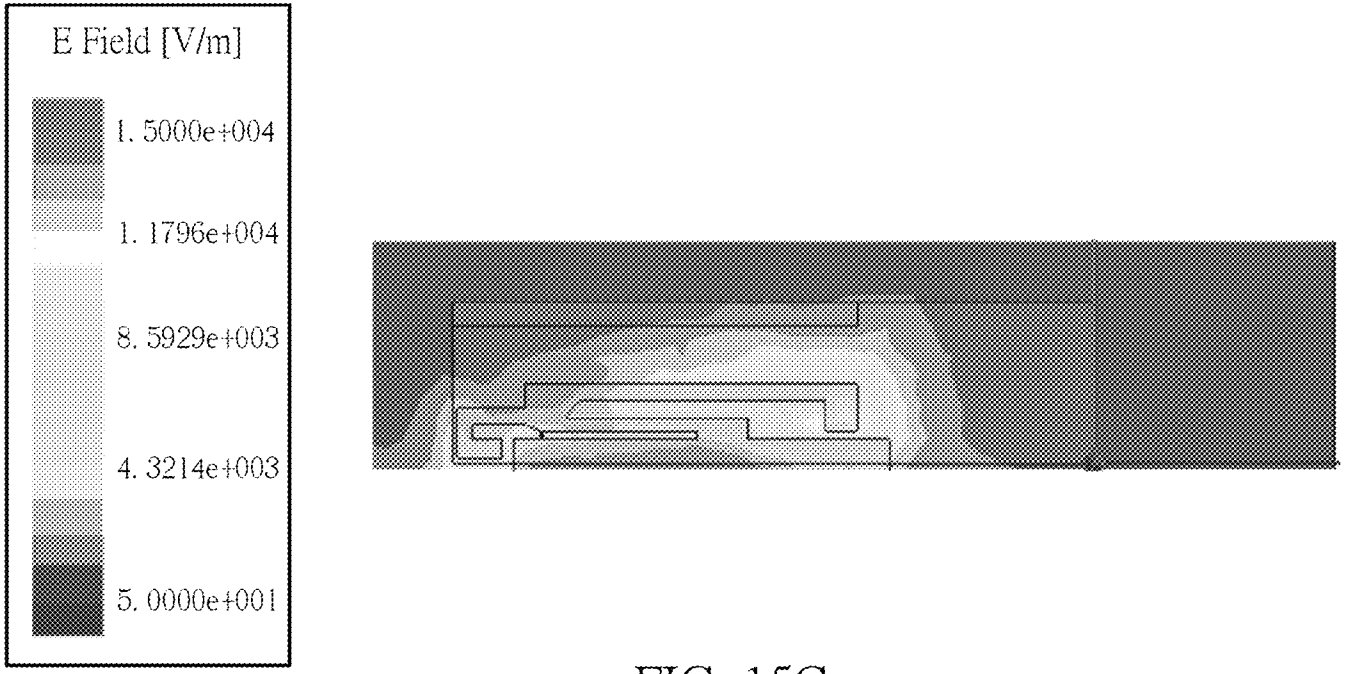
Figure 16A:
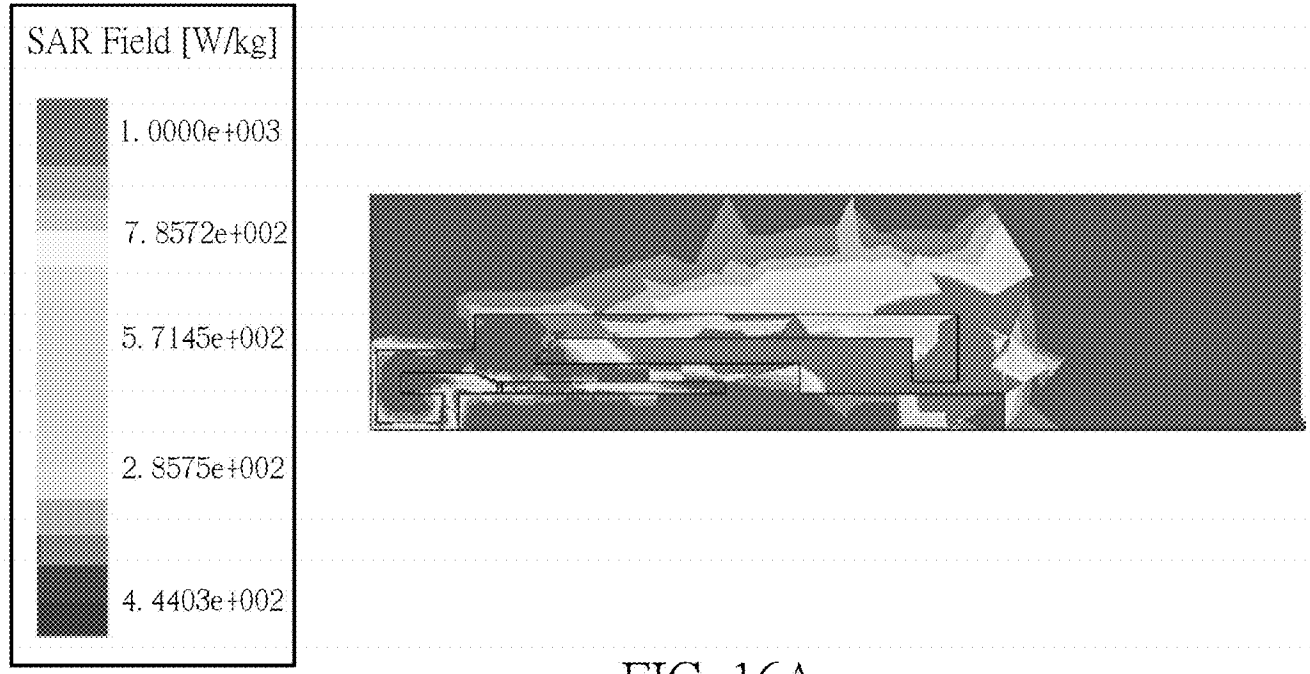
FIGS. 16A-16C are schematic diagrams of SAR fields of the antenna shown in FIG. 11, the RF transceiver device shown in FIG. 12 and the RF transceiver device shown in FIG. 13 at 2.21 GHz.
Figure 16B:
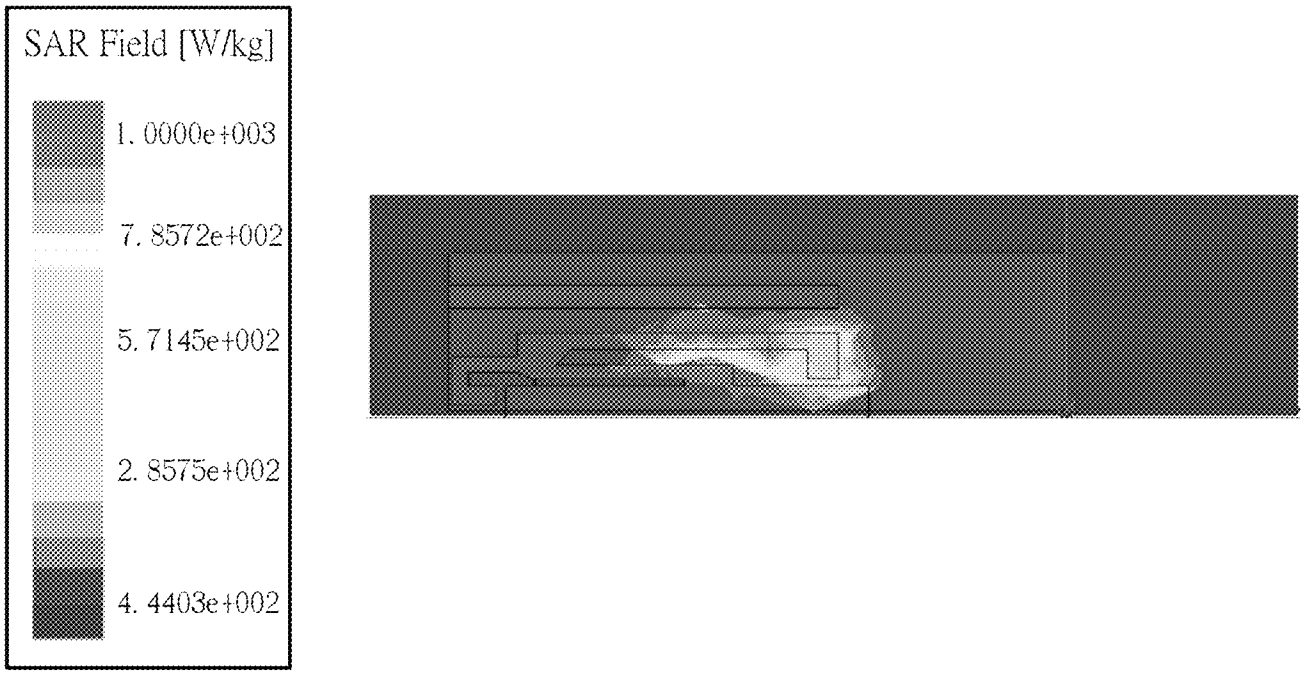
Figure 16C:
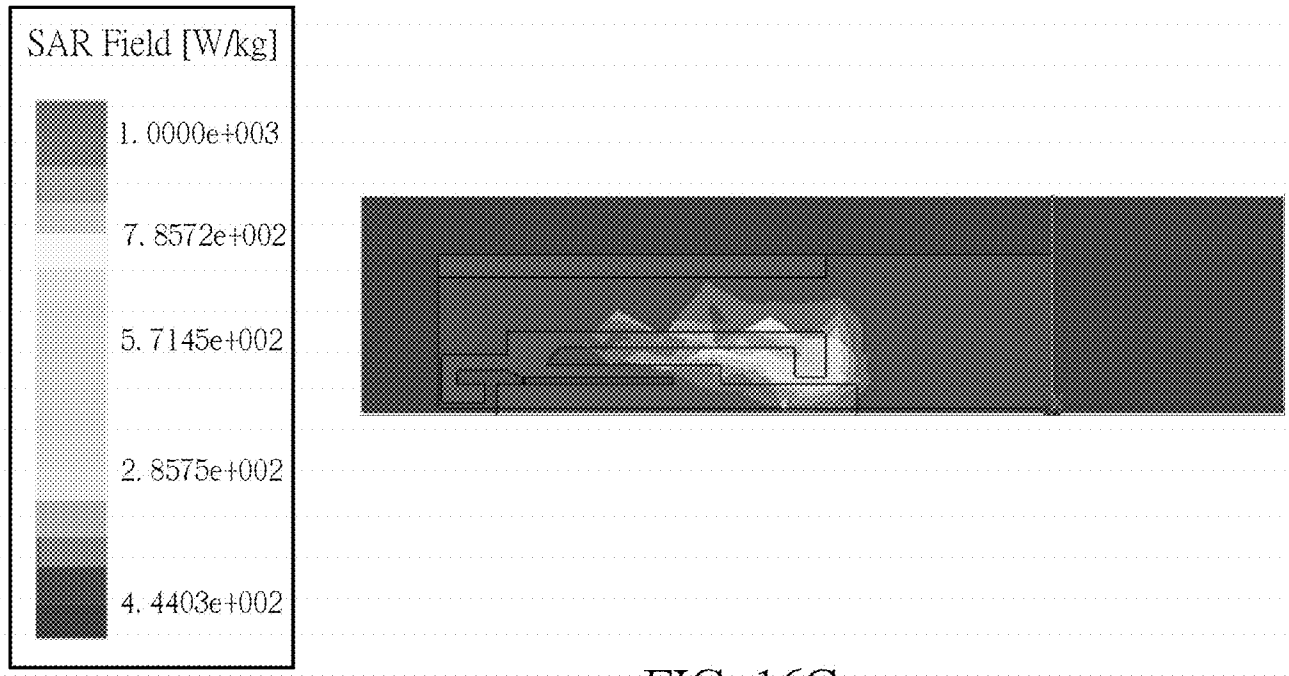
Figure 17A:
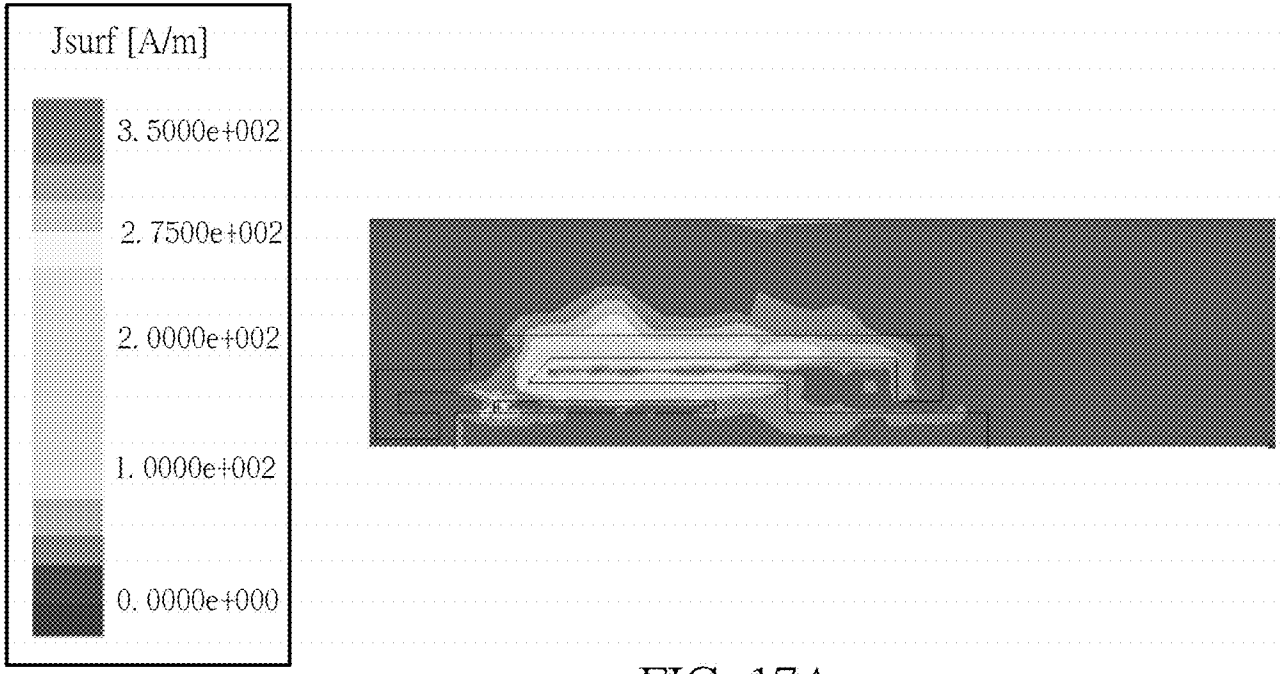
FIGS. 17A-17C are schematic diagrams of surface currents (Jsurf) of the antenna shown in FIG. 11, the RF transceiver device shown in FIG. 12 and the RF transceiver device shown in FIG. 13 at 2.21 GHz.
Figure 17B:
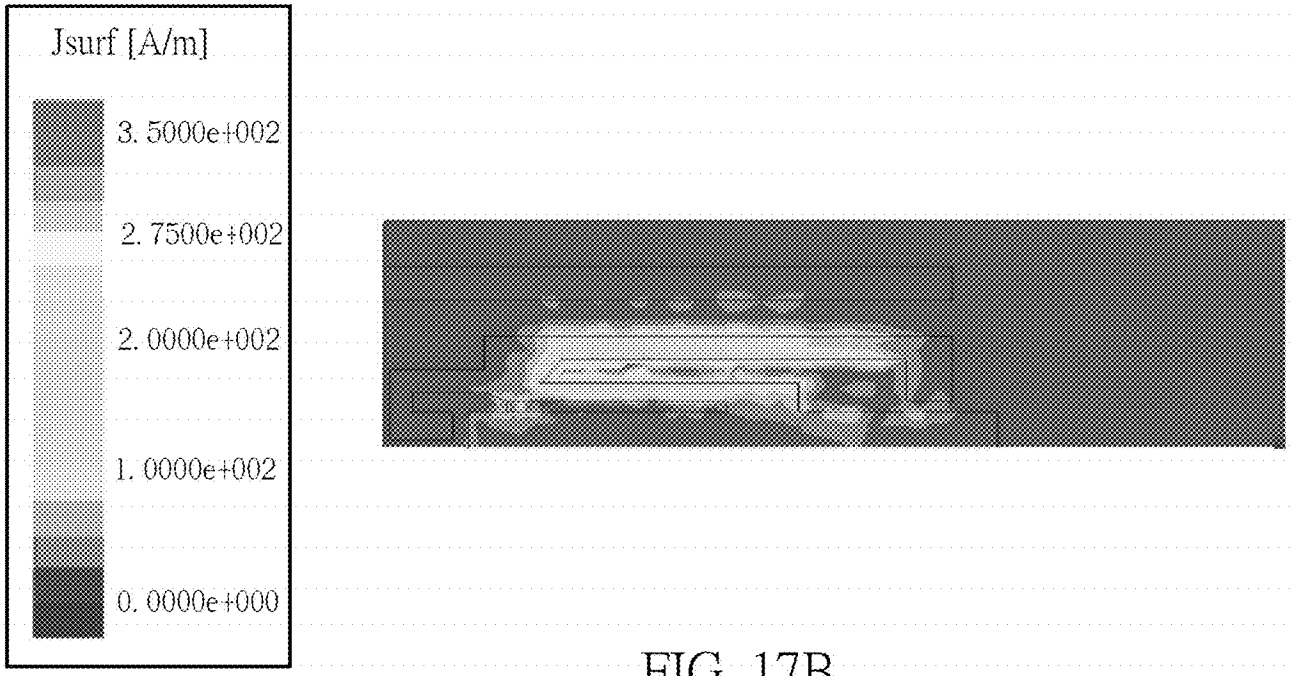
Figure 17C:
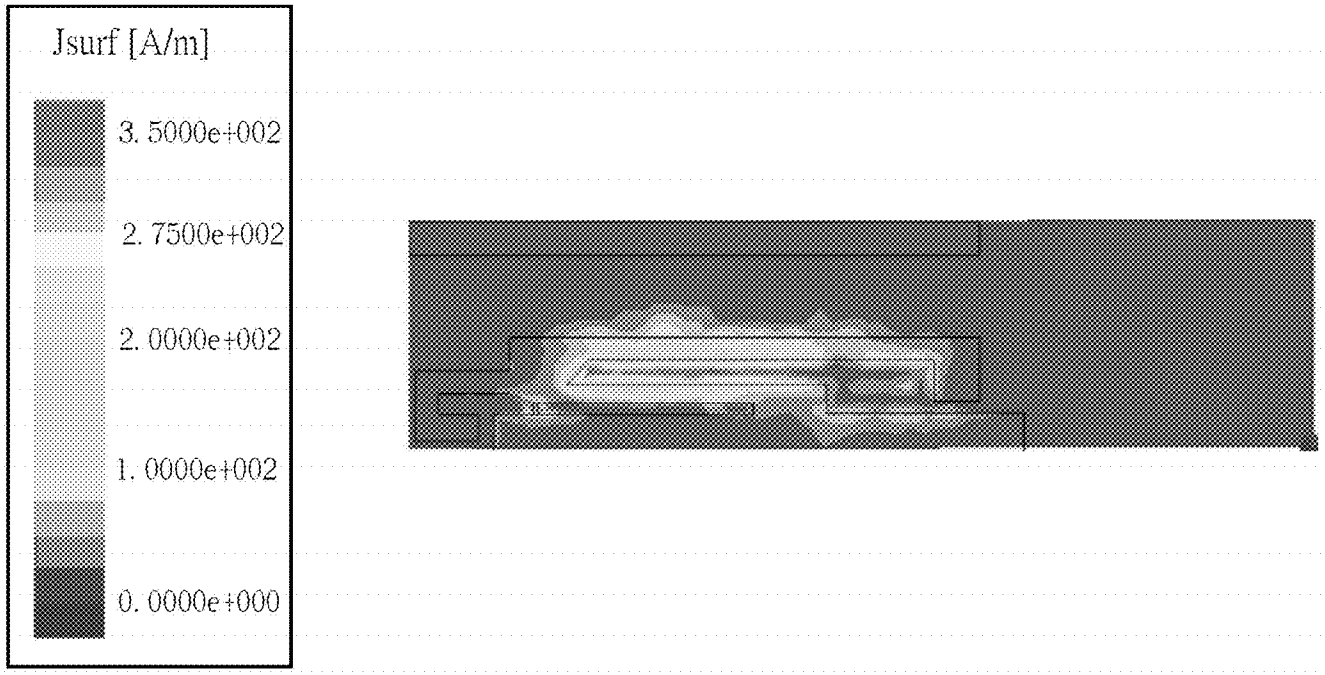
Figure 18A:
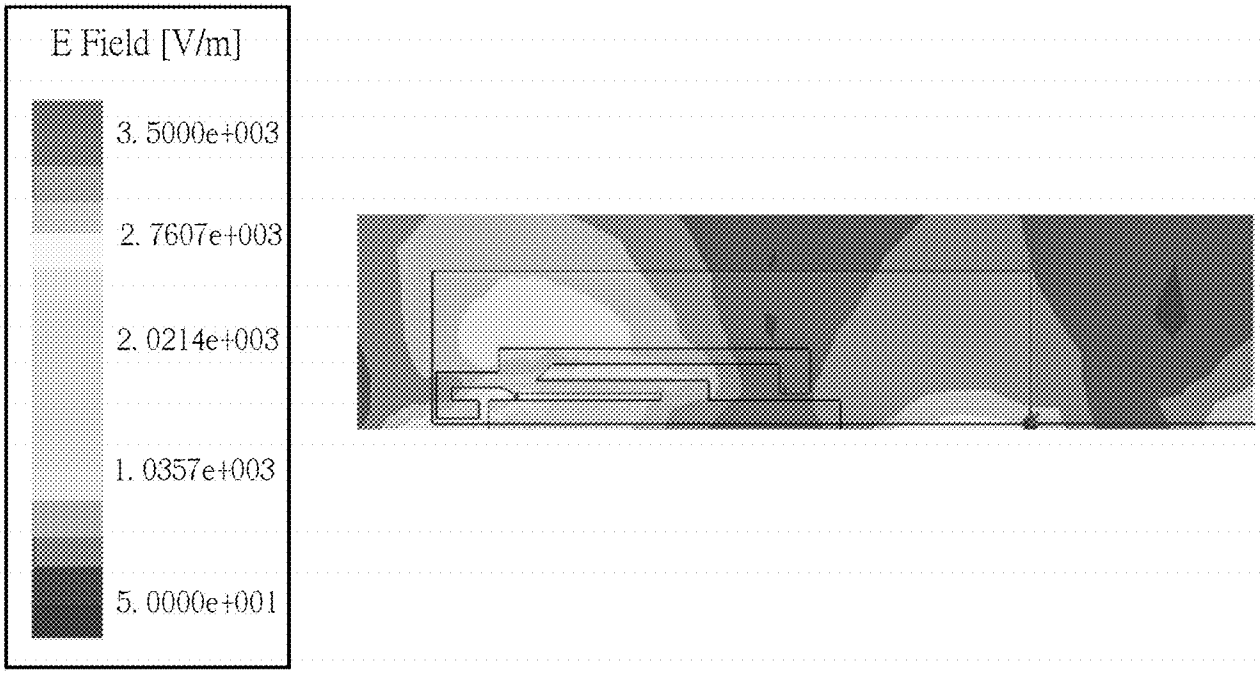
FIGS. 18A-18C are schematic diagrams of electric fields of the antenna shown in FIG. 11, the RF transceiver device shown in FIG. 12 and the RF transceiver device shown in FIG. 13 at 5.51 GHz.
Figure 18B:
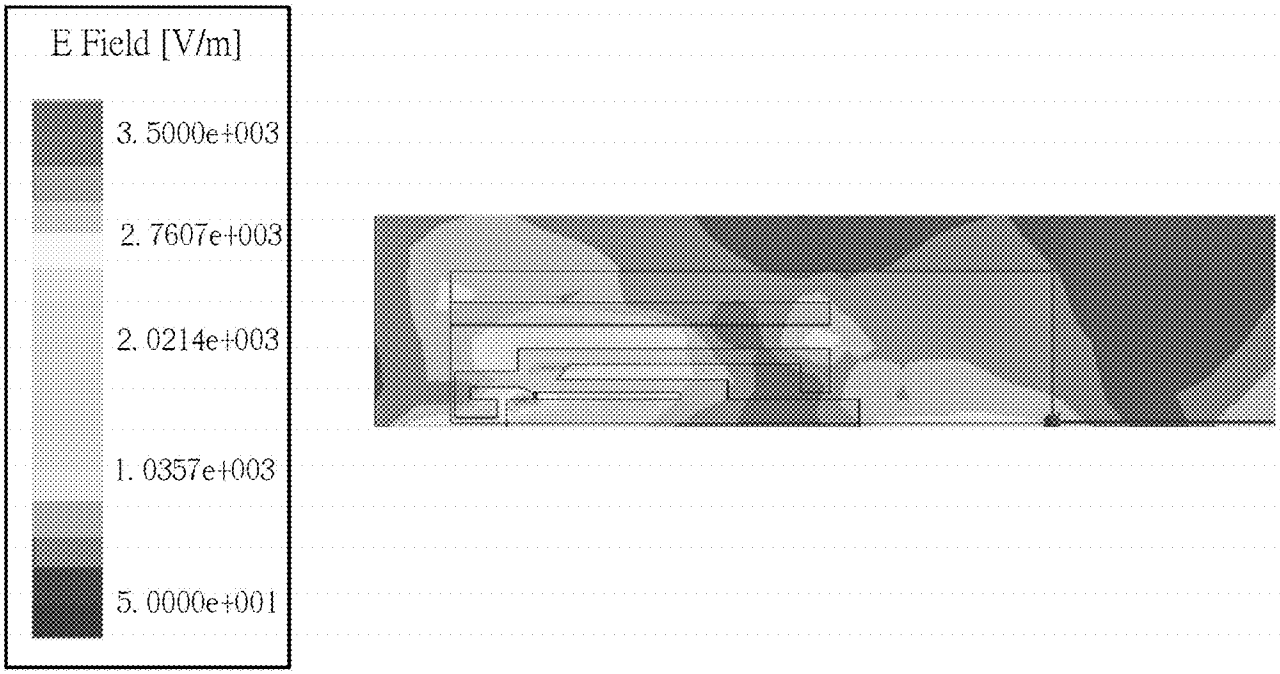
Figure 18C:
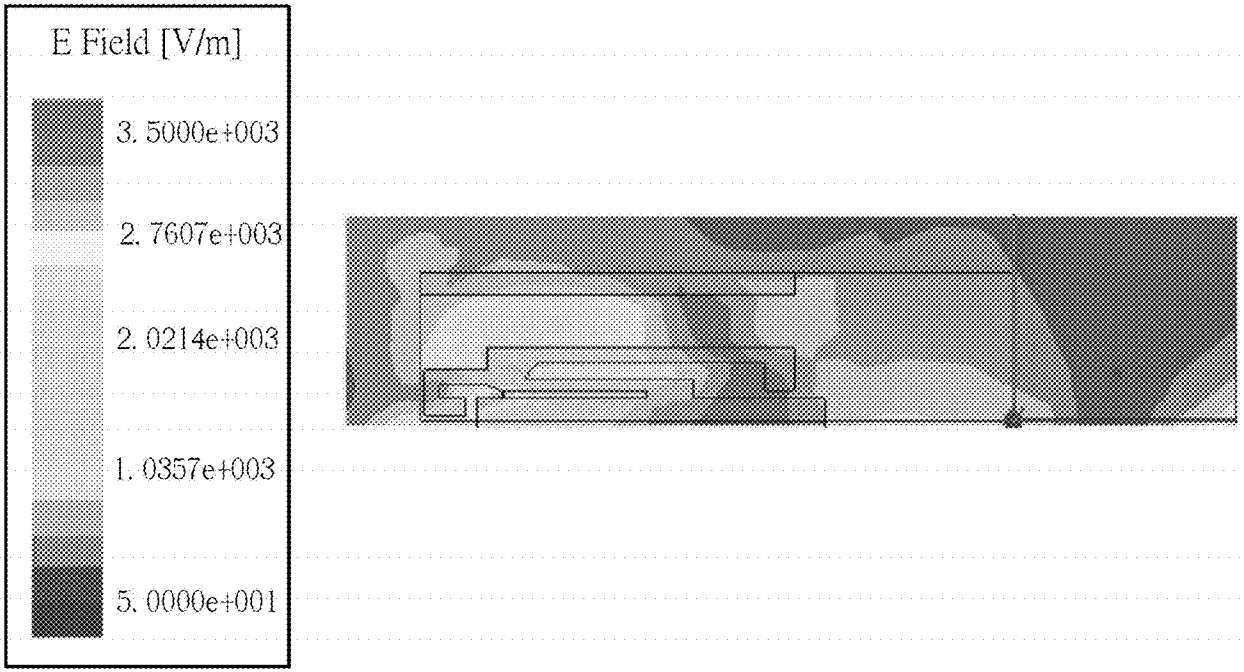
Figure 19A:
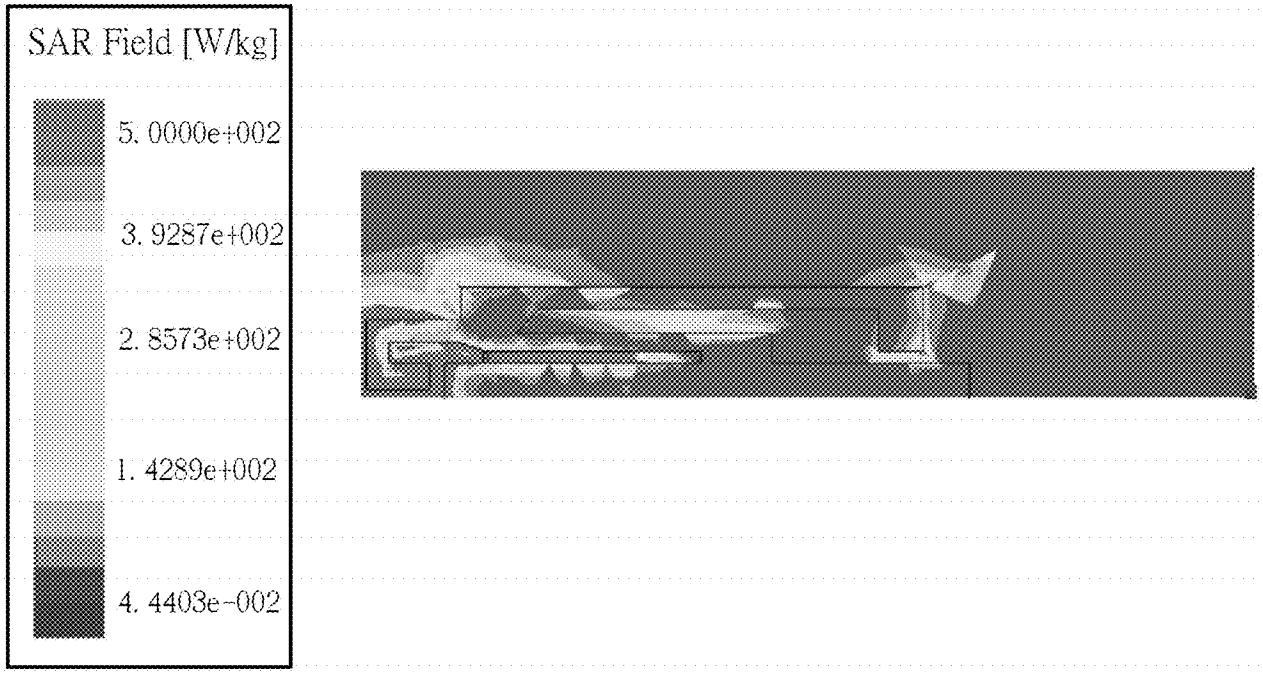
FIGS. 19A-19C are schematic diagrams of SAR fields of the antenna shown in FIG. 11, the RF transceiver device shown in FIG. 12 and the RF transceiver device shown in FIG. 13 at 5.51 GHz.
Figure 19B:
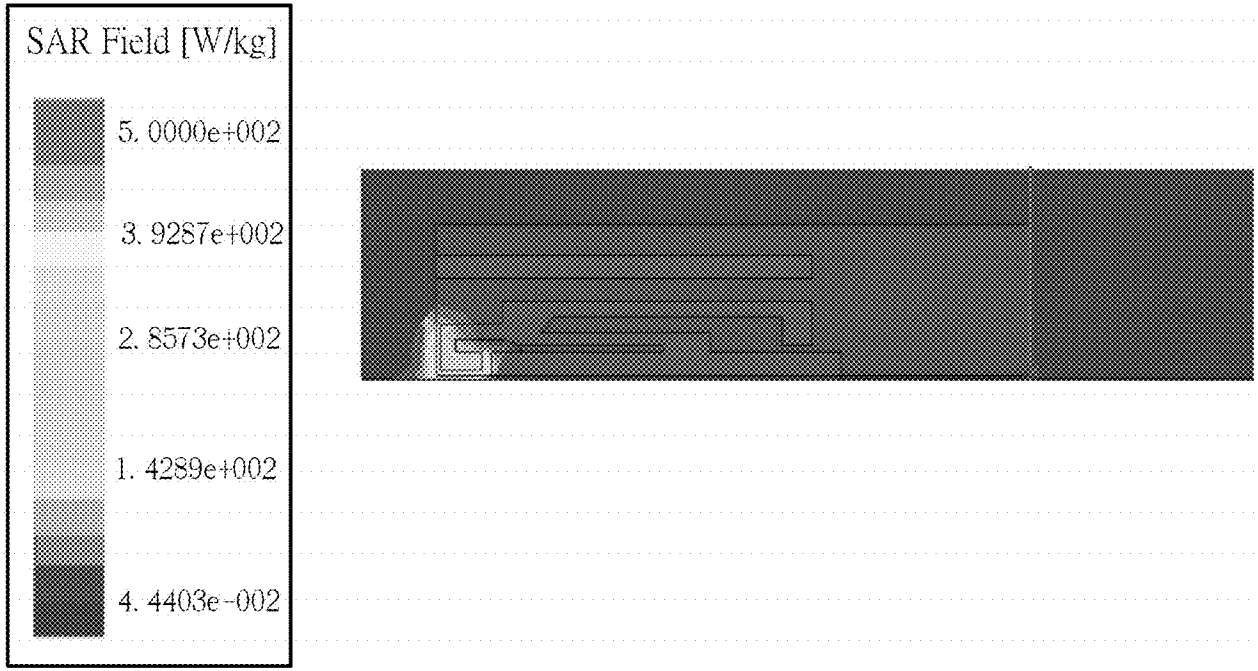
Figure 19C:
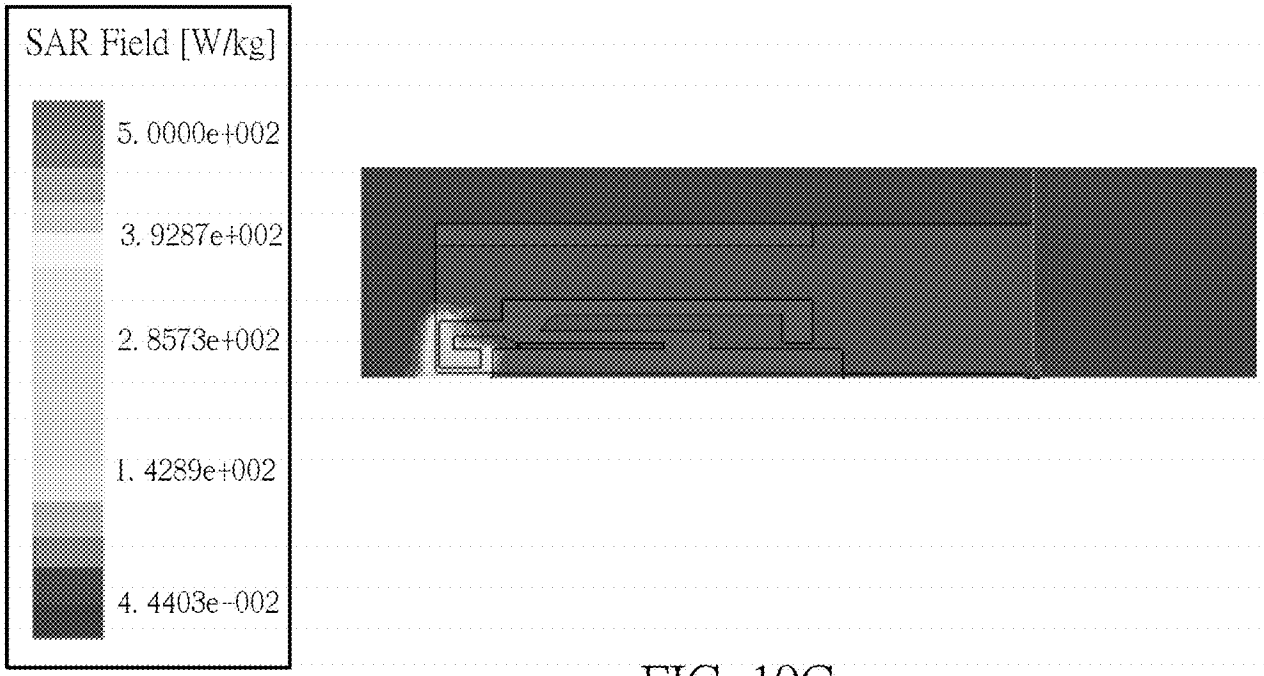
Figure 20A:
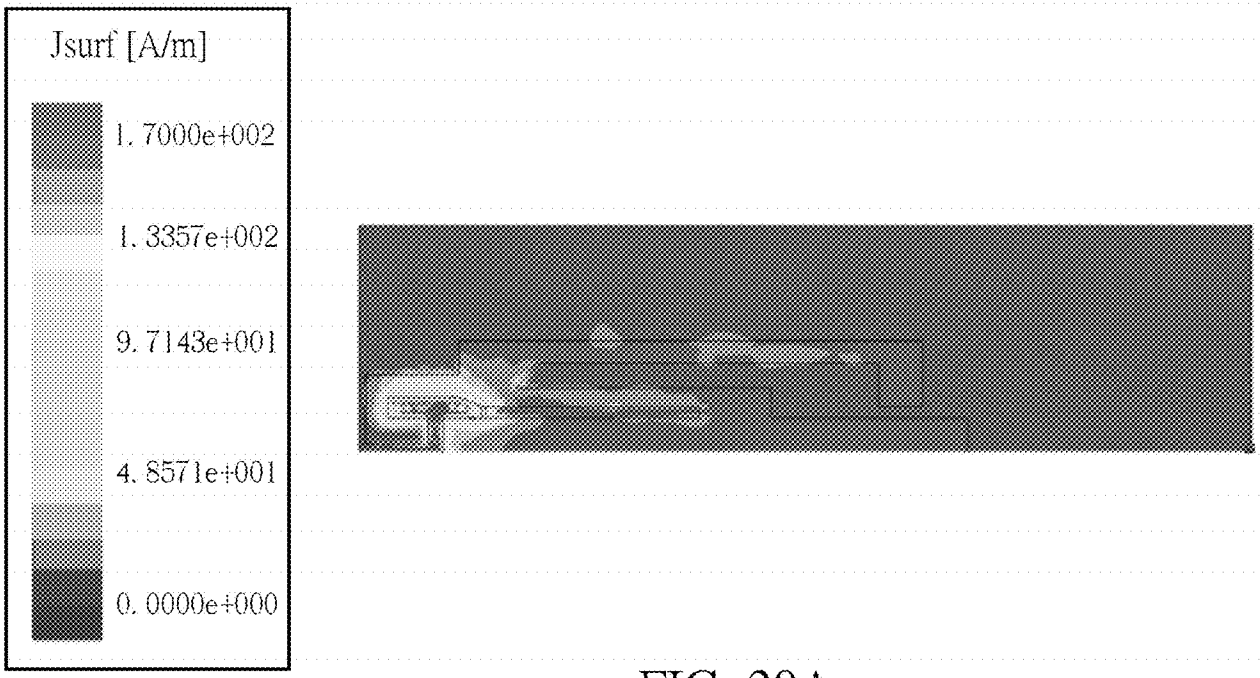
FIGS. 20A-20C are schematic diagrams of surface currents (Jsurf) of the antenna shown in FIG. 11, the RF transceiver device shown in FIG. 12 and the RF transceiver device shown in FIG. 13 at 5.51 GHz.
Figure 20B:
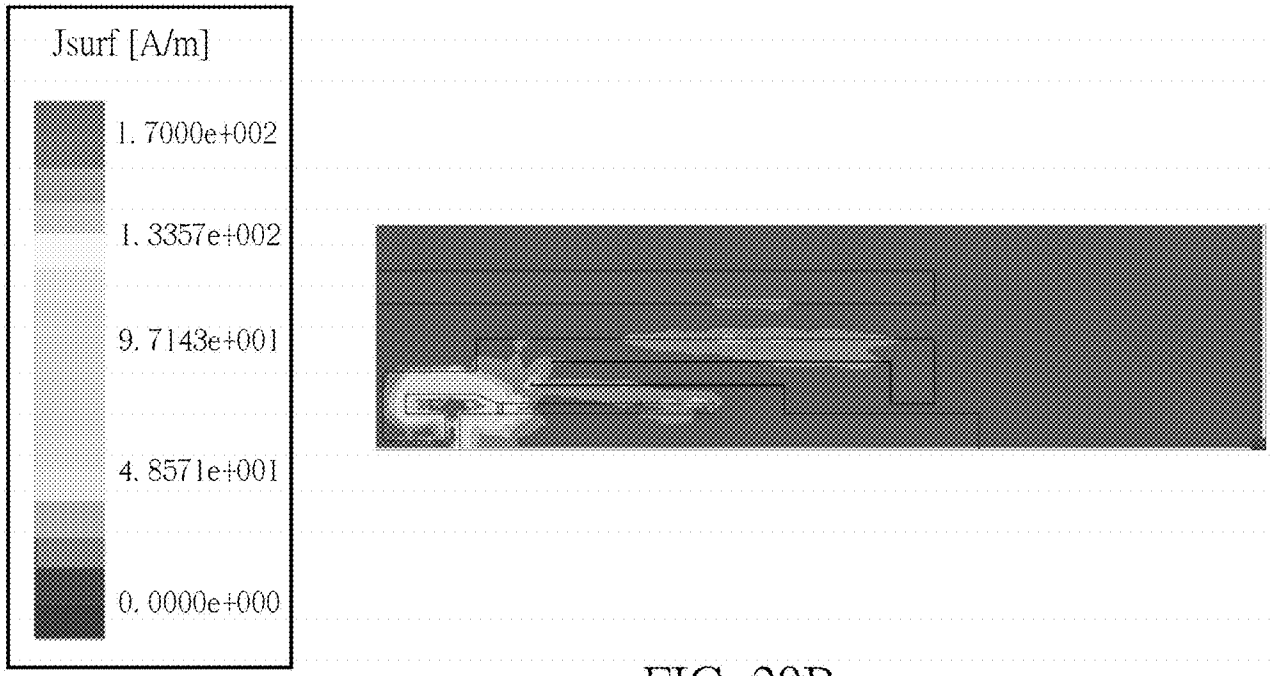
Figure 20C:
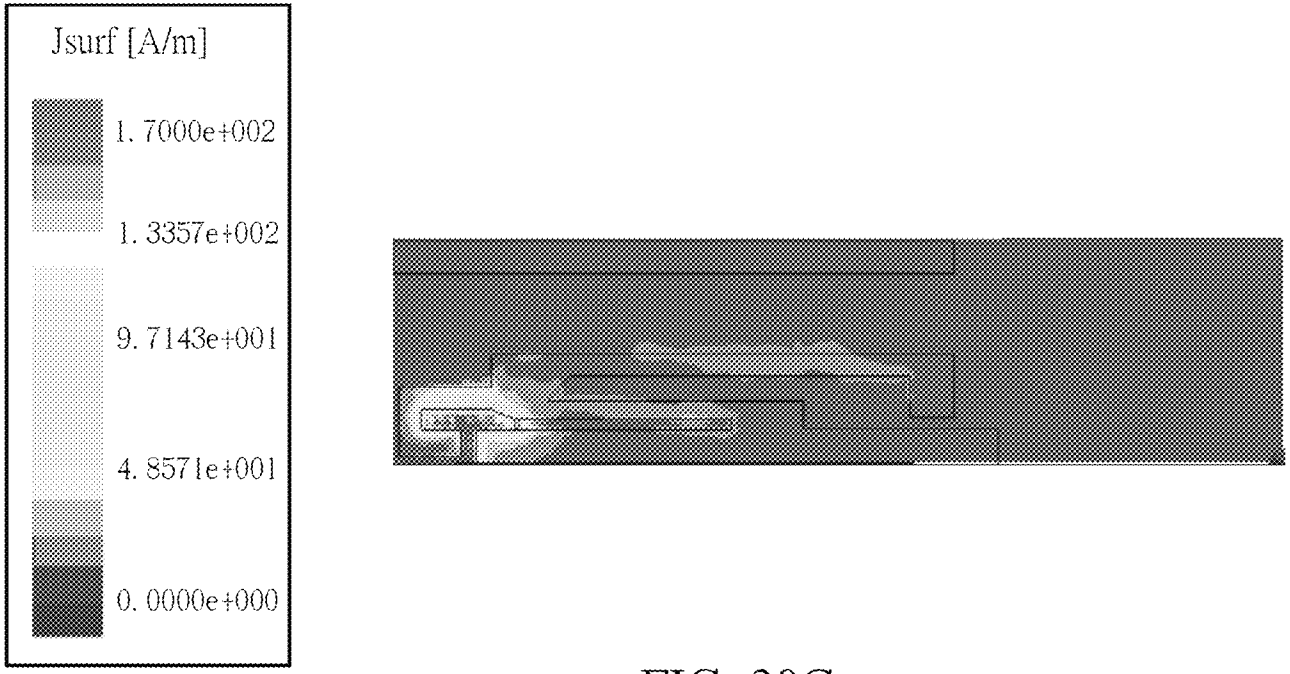

In detail, please refer to FIG. 14, 15A-15C, 16A-16C, 17A-17C, 18A-18C, 19A-19C and 20A-20C. FIG. 14 is a schematic diagram of Voltage Standing Wave Ratio (VSWR) of the antenna 1104 shown in FIG. 11, the RF transceiver device 1200 shown in FIG. 12 and the RF transceiver device 1300 shown in FIG. 13, where the solid curve represents VSWR of the antenna 1104 without the SAR suppression unit 1202 or 1302, the dashed curve represents VSWR of the RF transceiver device 1200, and the dotted line represents VSWR of the RF transceiver device 1300. As can be seen from FIG. 14, even if the SAR suppression unit 1202 or 1302 is added, the RF transceiver device 1200 or the RF transceiver device 1300 still operates in dual band accurately, so as to maintain the structure of the antenna 1104. Moreover, FIGS. 15A-15C are schematic diagrams of electric fields of the antenna 1104 shown in FIG. 11, the RF transceiver device 1200 shown in FIG. 12 and the RF transceiver device 1300 shown in FIG. 13 at 2.21 GHz. FIGS. 16A-16C are schematic diagrams of SAR fields of the antenna 1104 shown in FIG. 11, the RF transceiver device 1200 shown in FIG. 12 and the RF transceiver device 1300 shown in FIG. 13 at 2.21 GHz. FIGS. 17A-17C are schematic diagrams of surface currents (Jsurf) of the antenna 1104 shown in FIG. 11, the RF transceiver device 1200 shown in FIG. 12 and the RF transceiver device 1300 shown in FIG. 13 at 2.21 GHz. FIGS. 18A-18C are schematic diagrams of electric fields of the antenna 1104 shown in FIG. 11, the RF transceiver device 1200 shown in FIG. 12 and the RF transceiver device 1300 shown in FIG. 13 at 5.51 GHz. FIGS. 19A-19C are schematic diagrams of SAR fields of the antenna 1104 shown in FIG. 11, the RF transceiver device 1200 shown in FIG. 12 and the RF transceiver device 1300 shown in FIG. 13 at 5.51 GHz. FIGS. 20A-20C are schematic diagrams of surface currents (Jsurf) of the antenna 1104 shown in FIG. 11, the RF transceiver device 1200 shown in FIG. 12 and the RF transceiver device 1300 shown in FIG. 13 at 5.51 GHz. As can be seen from FIGS. 15A-15C, 16A-16C, 17A-17C, 18A-18C, 19A-19C and 20A-20C, at both 2.21 GHz and 5.51 GHz, the SAR suppression unit 1202 or 1302 indeed reduces vertical electric field of the antenna 1104, to reduce the SAR value, and causes little influence on the surface current, to maintain the antenna efficiency.

In the prior art, reducing SAR value inevitably reduces antenna efficiency, such that maintaining antenna efficiency and reducing the SAR value cannot be reached simultaneously. In comparison, the present invention adds the SAR suppression unit around the radiating element of the antenna, which can reduce SAR values for each operating band of the antenna while keeping the antenna efficiency or structure of the antenna.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A radio-frequency (RF) transceiver device, capable of reducing a specific absorption rate (SAR), comprising:

an antenna, comprising:

a grounding element, extending along a first direction on a first plane; and a radiating element, comprising:

a first branch, extending along the first direction, electrically connected to the grounding element;

a second branch, extending along the first direction;

a third branch, electrically connected to and perpendicular to the first branch and the second branch; and a fourth branch, extending along the first direction, electrically connected to the third branch; and a SAR suppression unit, for reducing the SAR of the antenna;

wherein the SAR suppression unit extends along the first direction and along an edge of the radiating element adjacent to the SAR suppression unit;

wherein the SAR suppression unit is separated from the edge of the radiating element by a gap;

wherein the antenna operates in a plurality of bands, and a length of the SAR suppression unit is equal to a quarter of wavelength corresponding to a lowest band within the plurality of bands;

wherein the SAR suppression unit is not electrically connected to the radiating element and the grounding element;

wherein the radiating element is positioned between the grounding element and the SAR suppression unit.

2. The RF transceiver device of claim 1, wherein the SAR suppression unit is a conductive unit.

3. The RF transceiver device of claim 1, wherein the SAR suppression unit is utilized for reducing SAR values of the antenna in the plurality of bands.

4. The RF transceiver device of claim 1, wherein the gap between the SAR suppression unit and the edge of the radiating element is substantially between 0.1 mm and 10 mm.

5. The RF transceiver device of claim 1, wherein the SAR suppression unit is disposed on the first plane.

6. The RF transceiver device of claim 1, wherein the SAR suppression unit is a cuboid disposed on a second plane perpendicular to the first plane, and extends along the first direction.

7. The RF transceiver device of claim 1, wherein the SAR suppression unit comprises at least a bend.

* * * * *